US010256569B2

(12) United States Patent
Ohtaka

(10) Patent No.: US 10,256,569 B2
(45) Date of Patent: Apr. 9, 2019

(54) CONNECTOR

(71) Applicant: Yazaki Corporation, Tokyo (JP)

(72) Inventor: Kazuto Ohtaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/651,859

(22) Filed: Jul. 17, 2017

(65) Prior Publication Data

US 2018/0026396 A1 Jan. 25, 2018

(30) Foreign Application Priority Data

Jul. 21, 2016 (JP) ..... 2016-143213

(51) Int. Cl.
*H01R 13/627* (2006.01)
*H01R 13/436* (2006.01)
*H01R 13/641* (2006.01)

(52) U.S. Cl.
CPC ..... *H01R 13/6272* (2013.01); *H01R 13/4367* (2013.01); *H01R 13/641* (2013.01)

(58) Field of Classification Search
CPC ..... H01R 13/6272; H01R 13/6275; H01R 13/641; H01R 13/4361–13/4368
USPC ..... 439/352, 357, 489
See application file for complete search history.

(56) References Cited

U.S. PATENT DOCUMENTS 5,120,255 A * 6/1992 Kouda ..... H01R 13/641 439/489
5,529,515 A * 6/1996 Ohtaka ..... H01R 13/4365 29/733
5,605,472 A * 2/1997 Sakai ..... H01R 13/6272 439/352
5,993,238 A * 11/1999 Kudo ..... H01R 13/6272 439/352

(Continued)

FOREIGN PATENT DOCUMENTS

CN 102549849 A 7/2012
CN 104348035 A 2/2015

(Continued)

OTHER PUBLICATIONS

Chinese Office Action for the related Chinese Patent Application No. 201710596249.7 dated Oct. 22, 2018.

*Primary Examiner* — Edwin A. Leon
*Assistant Examiner* — Milagros Jeancharles
(74) *Attorney, Agent, or Firm* — Kenealy Vaidya LLP

(57) ABSTRACT

A backlash elimination structure of a connector includes a first contact point of a detection member contacting a first target sliding portion of a housing in a temporary locked state release operation direction of a detection member between a temporary locking position and a main locking position of the detection member, and a second contact point contacting a second target sliding portion of the housing in a direction opposite to the release operation direction therebetween. The first contact point and the second contact point are disposed to be displaced from each other in a (Continued)

relative movement direction of the detection member. The detection member includes a base body which is separated from a wall portion, a wall body which connects the base body and the first contact point to each other, and a first target locking body which is disposed to be separated from the wall portion.

16 Claims, 19 Drawing Sheets

(56) References Cited

U.S. PATENT DOCUMENTS

| | | | | |
|---|---|---|---|---|
| 6,109,955 | A * | 8/2000 | Hanazaki | H01R 13/641 439/352 |
| 7,955,142 | B1 | 6/2011 | Shuey et al. | |
| 9,231,346 | B2 * | 1/2016 | Okano | H01R 13/6272 |
| 9,653,846 | B1 * | 5/2017 | Caldwell | H01R 13/62955 |
| 2002/0111059 | A1 | 8/2002 | Raudenbush et al. | |
| 2003/0049962 | A1 | 3/2003 | Raudenbush et al. | |
| 2004/0266265 | A1 | 12/2004 | Hayashi | |
| 2007/0178739 | A1 * | 8/2007 | Kuwayama | H01R 13/6272 439/352 |
| 2009/0149054 | A1 * | 6/2009 | Zheng | H01R 13/6272 439/357 |
| 2011/0008988 | A1 * | 1/2011 | Urano | H01R 13/6272 439/350 |
| 2011/0023274 | A1 * | 2/2011 | Urano | H01R 13/6272 24/591.1 |
| 2012/0156945 | A1 | 6/2012 | Matsumura et al. | |
| 2014/0134867 | A1 | 5/2014 | Kon et al. | |
| 2015/0037998 | A1 | 2/2015 | Kataoka et al. | |
| 2015/0111406 | A1 * | 4/2015 | Okano | H01R 13/639 439/352 |
| 2017/0373435 | A1 * | 12/2017 | Denz | H01R 13/6272 |

FOREIGN PATENT DOCUMENTS

| | | | |
|---|---|---|---|
| CN | 103811943 | B | 6/2016 |
| JP | 2001-307830 | A | 11/2001 |
| JP | 2002-280120 | A | 9/2002 |
| JP | 2012-169074 | A | 9/2012 |
| JP | 2014-99332 | A | 5/2014 |
| JP | 2014-170710 | A | 9/2014 |

* cited by examiner

CONNECTOR FITTING RELEASE DIRECTION

CONNECTOR FITTING DIRECTION

CONNECTOR

CROSS-REFERENCE TO RELATED APPLICATION(S)

The present application claims priority to and incorporates by reference the entire contents of Japanese Patent Application No. 2016-143213 filed in Japan on Jul. 21, 2016.

BACKGROUND OF THE INVENTION

1. Field of the Invention

The present invention relates to a connector.

2. Description of the Related Art

Conventionally, there is known a technique of determining whether a connector is completely fitted to a counterpart connector by an operator or the like. For example, the connector includes a detection member that is movable between a temporary locking position and a main locking position to be movable relative to a housing (see Japanese Patent Application Laid-open No. 2014-99332, Japanese Patent Application Laid-open No. 2001-307830, and Japanese Patent Application Laid-open No. 2002-280120). The detection member cannot be moved from the temporary locking position to the main locking position when the fitted state between the connector and the counterpart connector (between the connectors) is not complete (a so-called half fitted state) and can be moved from the temporary locking position to the main locking position when the fitted state is complete (a so-called complete fitted state). The operator or the like can determine whether the fitted state between the connectors is complete based on the positional relation of the detection member relative to the housing.

Incidentally, when the posture of the detection member relative to the housing is inclined to be displaced from a normal posture, the detection member cannot move smoothly relative to the housing between the temporary locking position and the main locking position. Thus, there is a possibility that the fitted state between the connectors may not be accurately detected. For this reason, the known connector has a configuration in which the detection member is provided with, for example, a plurality of protrusion portions which protrude in the same direction (one direction of a plurality of directions orthogonal to the relative movement direction) so that the detection member is maintained in a normal posture or the detection member is bent at a certain position in that direction to eliminate a backlash between the housing and the detection member in that direction. Here, it is desirable to maintain the posture of the detection member in the normal posture between the temporary locking position and the main locking position in order to correctly detect the fitted state between the connectors. For this reason, there is a room for improvement. Further, when the detection member cannot easily move due to a friction resistance in accordance with the elimination of the backlash between the housing and the detection member, there is a possibility that the detection member cannot easily move to the main locking position even in the complete fitted state. Therefore, it is desirable to consider the operability of the detection member with respect to the housing. In this way, the known connector needs to be further improved to detect the fitted state between the connectors.

SUMMARY OF THE INVENTION

Here, an object of the present invention is to provide a connector capable of improving the detection accuracy of a fitted state.

In order to achieve the above mentioned object, a connector according to one aspect of the present invention includes a terminal; a housing that accommodates and holds the terminal and engages with a counterpart housing when a fitted state with respect to a counterpart connector is in a complete fitted state; a detection member that is assembled to the housing and is movable relative to the housing between a temporary locking position until the fitted state becomes the complete fitted state and a main locking position when the fitted state is in the complete fitted state; a temporary locking release structure that presses a temporary locking release portion of the detection member in a release operation direction orthogonal to a relative movement direction of the detection member during the relative movement, and releases a temporary locked state of the detection member at the temporary locking position; and a backlash elimination structure that sets a backlash amount between the housing and the detection member to be zero in the release operation direction and the opposite direction thereof, wherein the backlash elimination structure includes first and second target sliding portions which are formed at the housing to follow the relative movement direction, a first contact point which is provided at the detection member and contacts the first target sliding portion in the release operation direction between the temporary locking position and the main locking position, and a second contact point which is provided at the detection member and contacts the second target sliding portion in a direction opposite to the release operation direction between the temporary locking position and the main locking position, the first contact point and the second contact point are disposed to be displaced from each other in the relative movement direction, the detection member includes a base body which is disposed at the first contact point on the side of the release operation direction and is disposed in the release operation direction to be separated from a wall portion located on the side of the release operation direction in relation to the first target sliding portion of the housing, a first connection body which connects the base body and the first contact point to each other, and a second connection body which is disposed to be separated from the wall portion in the release operation direction and connects the base body and the second contact point to each other, and the detection member has flexibility so that the base body moves in a direction opposite to the release operation direction to approach the wall portion.

According to another aspect of the present invention, in the connector, it is desirable that a plurality of the first connection bodies are provided to be separated from each other in a direction orthogonal to the release operation direction and the relative movement direction of the base body, and the first contact point is provided at each of the first connection bodies.

According to still another aspect of the present invention, in the connector, it is desirable that the second contact point is provided at a contact body continuous to the second connection body or is an end of the second connection body.

According to still another aspect of the present invention, in the connector, it is desirable that the second contact point is disposed at the base body on a side opposite to the relative movement direction.

According to still another aspect of the present invention, in the connector, it is desirable that the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

The above and other objects, features, advantages and technical and industrial significance of this invention will be better understood by reading the following detailed description of presently preferred embodiments of the present invention, when considered in connection with the accompanying drawings.

DETAILED DESCRIPTION OF THE PREFERRED EMBODIMENTS

Figure 1:
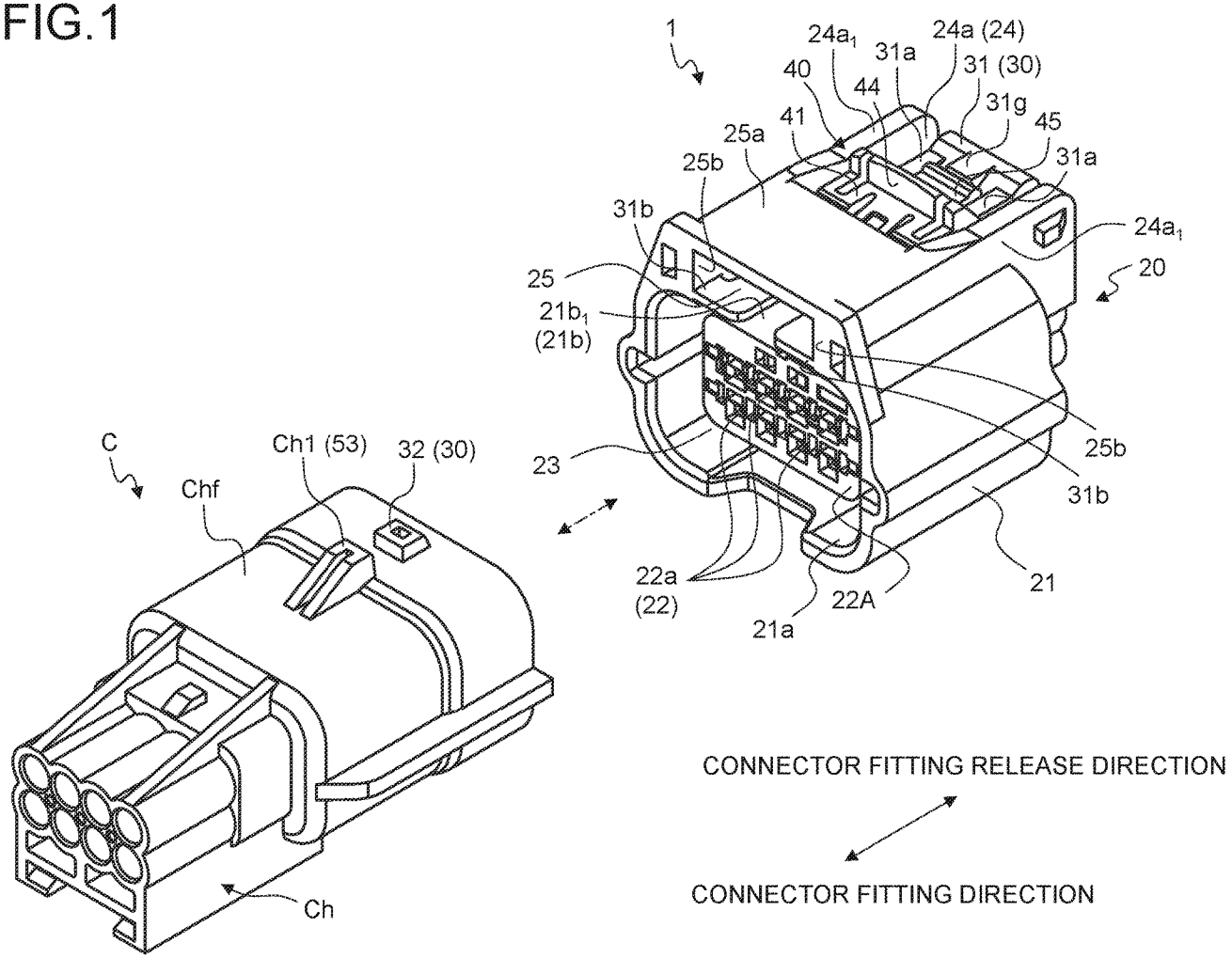
FIG. 1 is a perspective view illustrating a connector of an embodiment and illustrates a state where the connector is not fitted to a counterpart connector.

Hereinafter, an embodiment of a connector according to the present invention will be described in detail with reference to the drawings. Further, the present invention is not limited to the embodiment.

Embodiment

An embodiment of a connector according to the present invention will be described with reference to FIGS. 1 to 11.

Reference Numeral 1 of FIGS. 1 to 6 denotes a connector of the embodiment. The connector 1 includes a terminal 10 (FIG. 3) and a housing 20 which accommodates and holds the terminal 10.

The terminal 10 is formed of a conductive material such as metal to have a predetermined shape and is physically and electrically connected to a core wire of a terminal of an electric wire WH (FIG. 3) by a predetermined connection method such as clamping or welding. The terminal 10 includes a terminal connection portion 11 to which a counterpart terminal (not illustrated) of a counterpart connector C (FIG. 1) is connected and an electric wire connection portion 12 to which a core wire of the electric wire WH is connected. In the embodiment, the terminal 10 of the connector 1 is molded as a female terminal and the counterpart terminal of the counterpart connector C is molded as a male terminal. Here, any one of the terminal 10 and the counterpart terminal may be a female terminal or a male terminal as long as both terminals are physically and electrically connected to each other in a fitted state.

Figure 2:
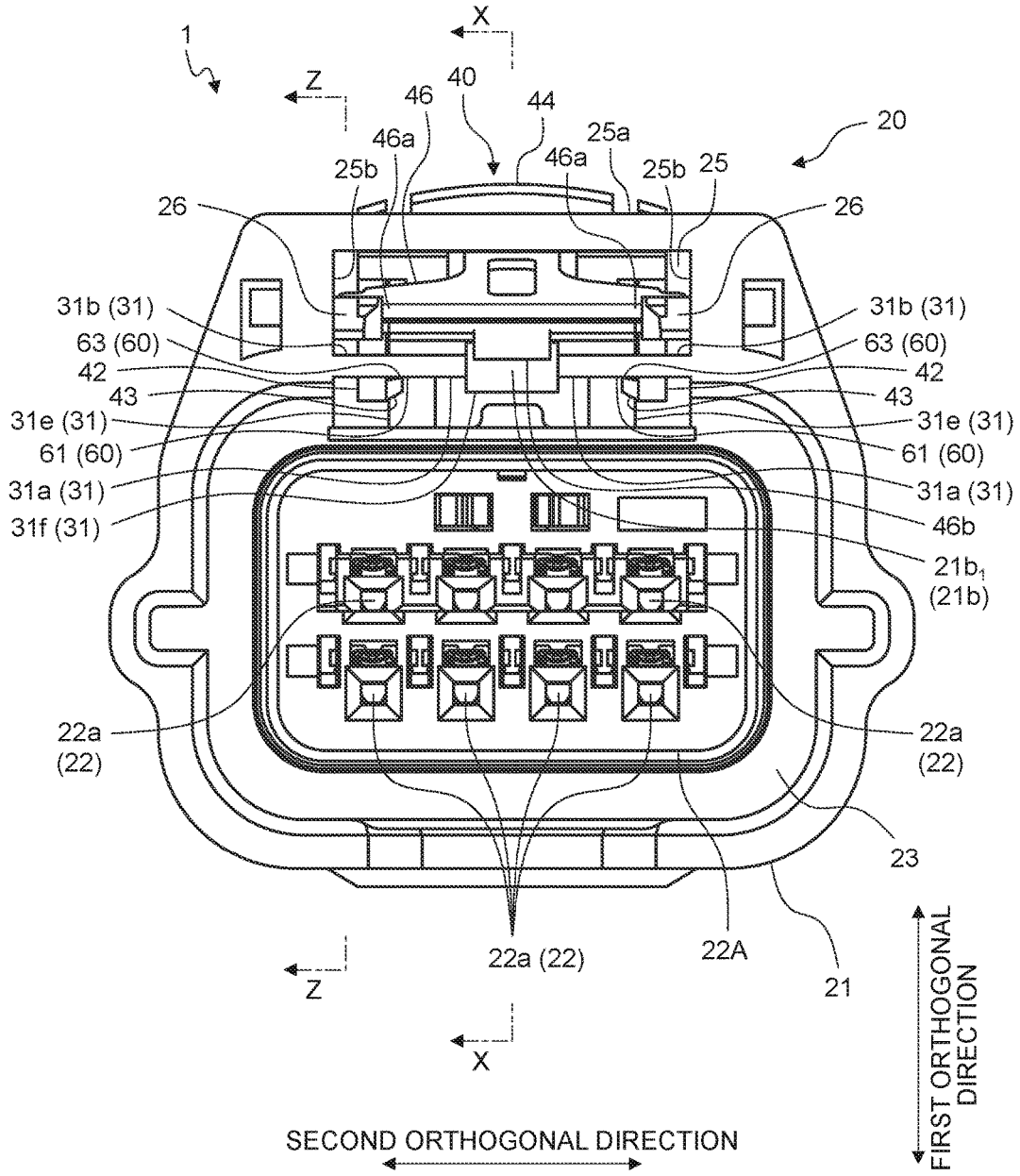
FIG. 2 is a front view illustrating the connector of the embodiment when viewed from the counterpart connector.
Figure 3:
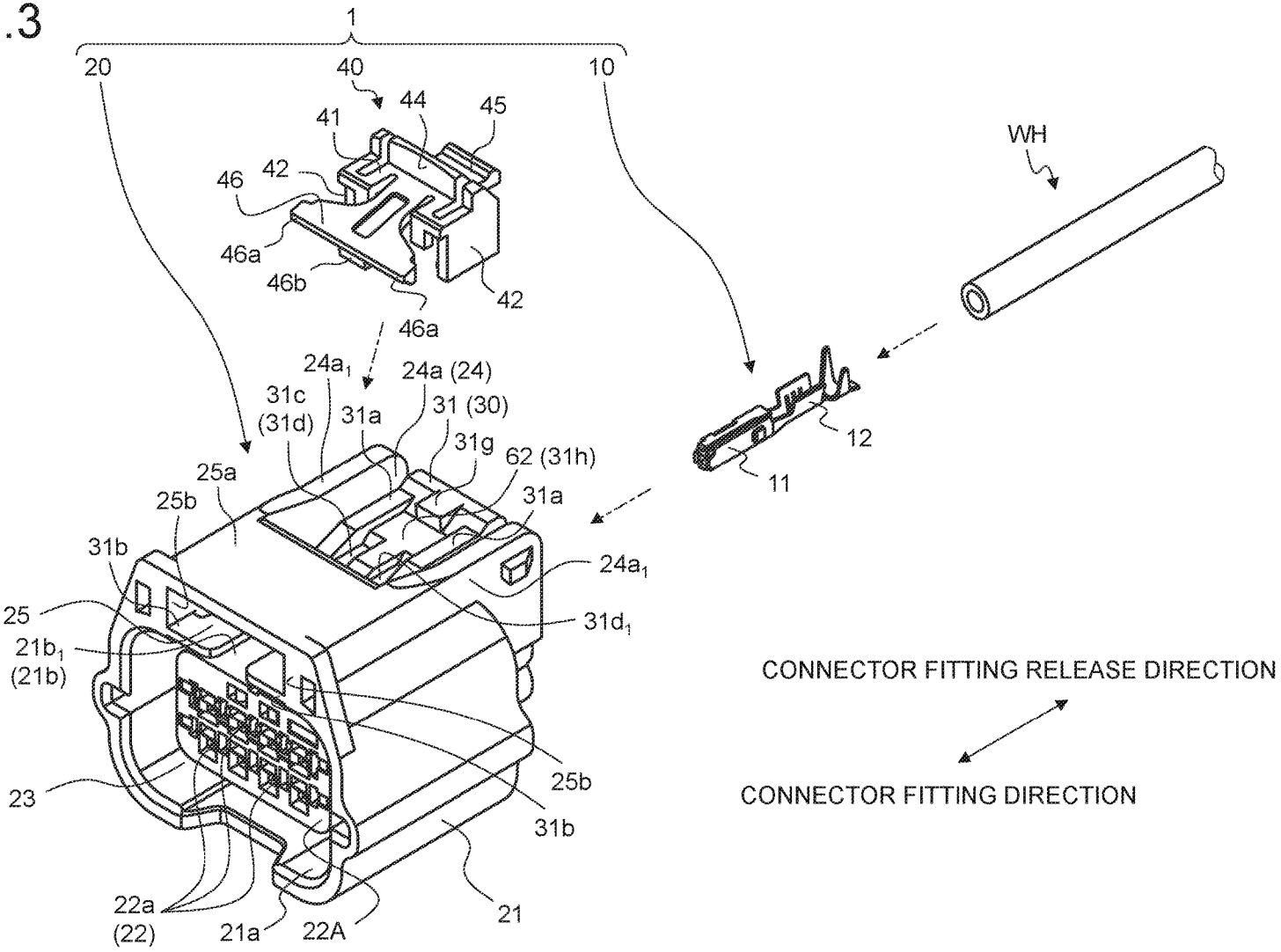
FIG. 3 is an exploded perspective view illustrating the connector of the embodiment.
Figure 4:
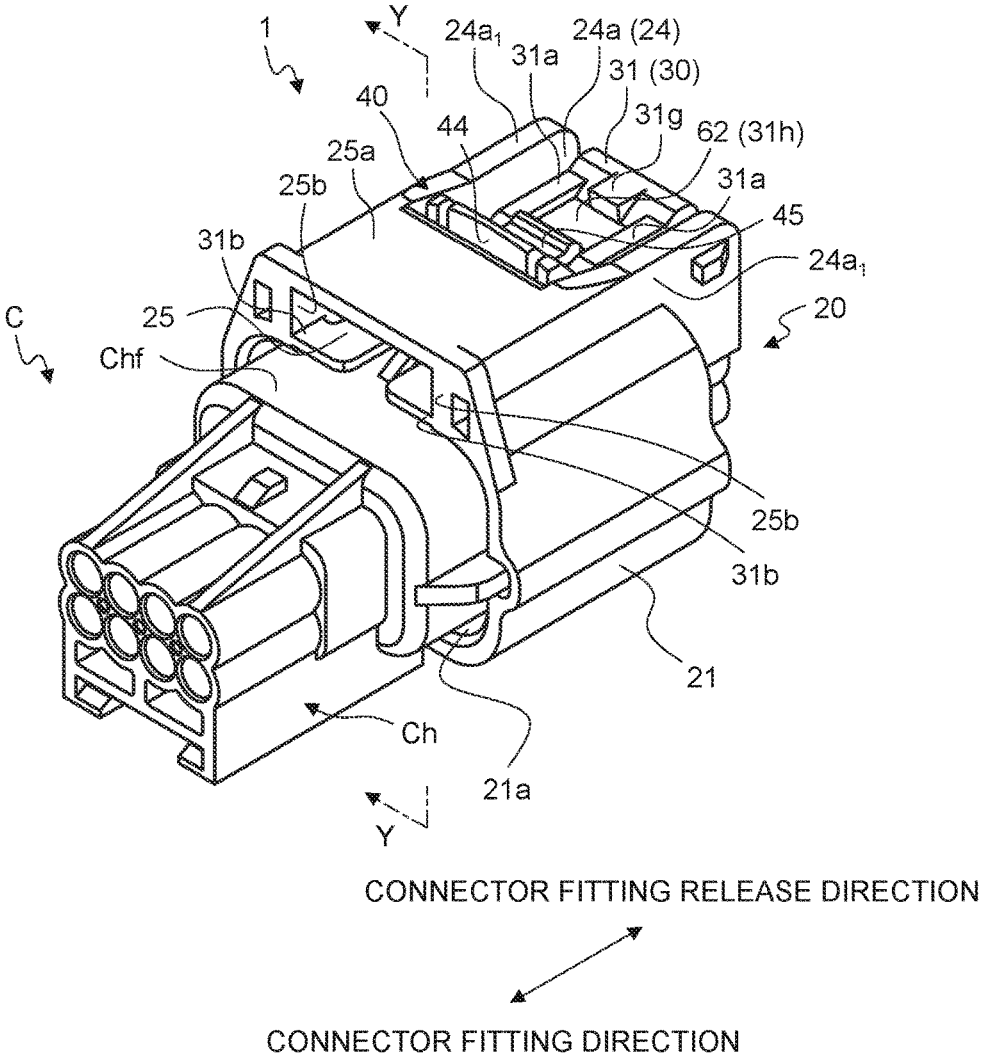
FIG. 4 is a perspective view illustrating the connector of the embodiment and illustrates a complete fitted state after the connector is completely fitted to the counterpart connector.

The housing 20 is molded into a predetermined shape by an insulating material such as a synthetic resin. The housing 20 is provided with a cylindrical hood 21 and a plurality of terminal storage rooms 22 which are disposed inside the hood 21 and respectively accommodate and hold the terminals 10 (FIGS. 1 to 3). In the housing 20, a space portion (hereinafter, referred to as an "annular space portion") 23 having an annular shape is formed between the hood 21 and an assembly of the terminal storage rooms 22. In a connector fitting step of fitting the connector 1 and the counterpart connector C to each other, a cylindrical hood Chf (FIG. 1) of a counterpart housing Ch of the counterpart connector C is accommodated in the annular space portion 23 to surround the assembly of the terminal storage rooms 22 at the inside thereof. A plurality of counterpart terminals are accommodated and held inside the hood Chf. In FIG. 3, only a pair of the terminal 10 and the electric wire WH are illustrated for convenience of description.

The hood 21 is disposed so that the cylinder axis direction follows a fitting direction to the counterpart connector C (hereinafter, referred to as a "connector fitting direction") or the opposite direction (hereinafter, referred to as a "connector fitting release direction"). In the description below, both directions will be generally referred to as an insertion/extraction direction (hereinafter, referred to as a "connector insertion/extraction direction") between the connector 1 and the counterpart connector C. The hood 21 includes an opening portion 21*a* on the side of the connector fitting direction. The counterpart connector C is inserted from the opening portion 21*a*. The hood 21 of the embodiment is formed in a rectangular cylindrical shape.

Each terminal storage room 22 is formed so that the terminal 10 is accommodated in the connector insertion/extraction direction. The terminal storage room 22 includes an opening portion 22*a* on the side of the connector fitting direction and the terminal connection portion 11 of the inner terminal 10 is exposed to the outside through the opening portion 22*a*. In the connector fitting step, the counterpart terminal is inserted from the opening portion 22*a* into the terminal storage room 22 and is fitted to the terminal connection portion 11 of the terminal 10. In the terminal storage room 22, an opening portion (not illustrated) is also provided on the side of the connector fitting release direction and the electric wire WH connected to the electric wire connection portion 12 of the inner terminal 10 is drawn to the outside from the opening portion on the side of the connector fitting release direction. The terminal storage rooms 22 of the embodiment are arranged in a lattice shape at the inside of a rectangular terminal storage body 22A disposed at the inside of the rectangular cylindrical hood 21 and a portion at the side in the connector fitting release direction protrudes from the hood 21.

A holding structure 30 is provided between the connector 1 and the counterpart connector C to engage the housing 20 and the counterpart housing Ch with each other when the fitted state therebetween is a complete fitted state (FIG. 4) so that the complete fitted state is maintained (FIGS. 1 and 3 to FIG. 6). The complete fitted state indicates a state where the connector 1 and the counterpart connector C are inserted to each other according to a design and the terminal 10 and the counterpart terminal are physically and electrically connected to each other. Meanwhile, in the connector fitting step, the fitted state between the connector 1 and the counterpart connector C (hereinafter, referred to as "between the connectors") will be referred to as a half fitted state before the complete fitted state.

The holding structure 30 is a so-called lock structure between the connectors. The housing 20 includes a holding body (hereinafter, a "first holding body") 31 which engages with the counterpart housing Ch to keep the complete fitted state (FIG. 1 to FIGS. 3, 5, and 6). Meanwhile, the counterpart housing Ch includes a holding body (hereinafter, referred to as a "second holding body") 32 which engages with the first holding body 31 (FIGS. 1 and 6).

The first holding body 31 is a so-called locking arm and is integrated with one of four wall bodies of the rectangular cylindrical hood 21. In the hood 21 of this example, a wall body which is an installation target of the first holding body 31 is divided in the circumferential direction and a gap 21*b* is provided between two free ends facing each other in the circumferential direction (FIGS. 1 to 6). The first holding body 31 is disposed at the gap 21*b*.

The first holding body 31 includes two arms 31*a* which extend in the connector insertion/extraction direction and are disposed to be separated from each other in the circumferential direction of the hood 21 and to be separated from the outer wall surface of the terminal storage body 22A (FIGS. 1 to 6). Each arm 31*a* extends across the opening portion 21*a* of the hood 21 (that is, the end of the housing 20 at the side of the connector fitting direction) and the end of the terminal storage body 22A on the side of the connector fitting release direction (that is, the end of the housing 20 on the side of the connector fitting release direction). The end of one arm 31*a* on the side of the connector fitting direction is connected to one free end of the hood 21 in the circumferential direction. The end of the other arm 31*a* on the side of the connector fitting direction is connected to the other free end of the hood 21 in the circumferential direction. The end of each arm 31*a* on the side of the connector fitting direction is connected to the free end of the hood 21 through each of a first arm connection portions 31*b* (FIGS. 1 to 4).

Figure 5:
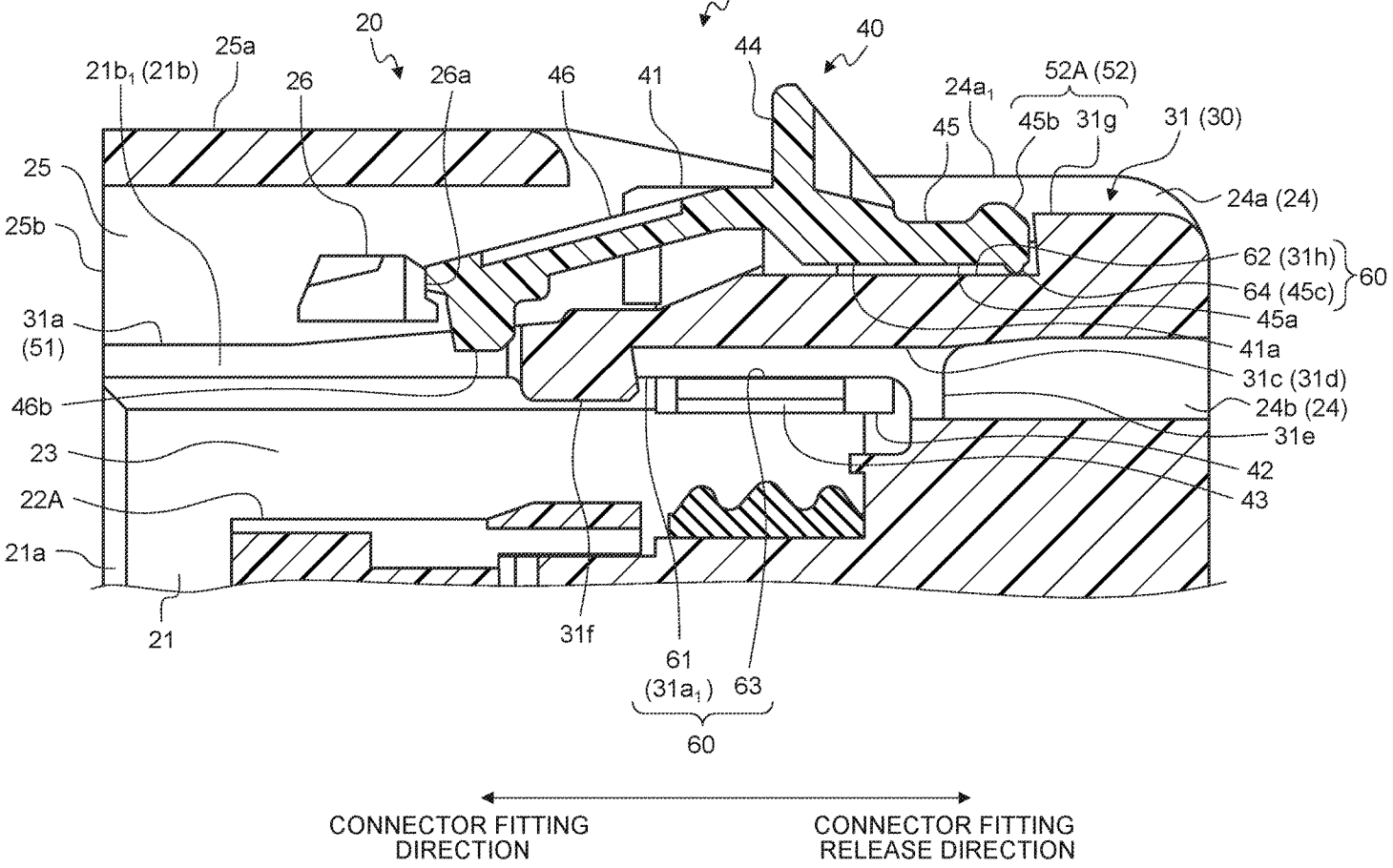
FIG. 5 is a cross-sectional view taken along a line X-X of FIG. 2 and is a diagram in which the periphery of a detection member at a temporary locking position is extracted.
Figure 6:
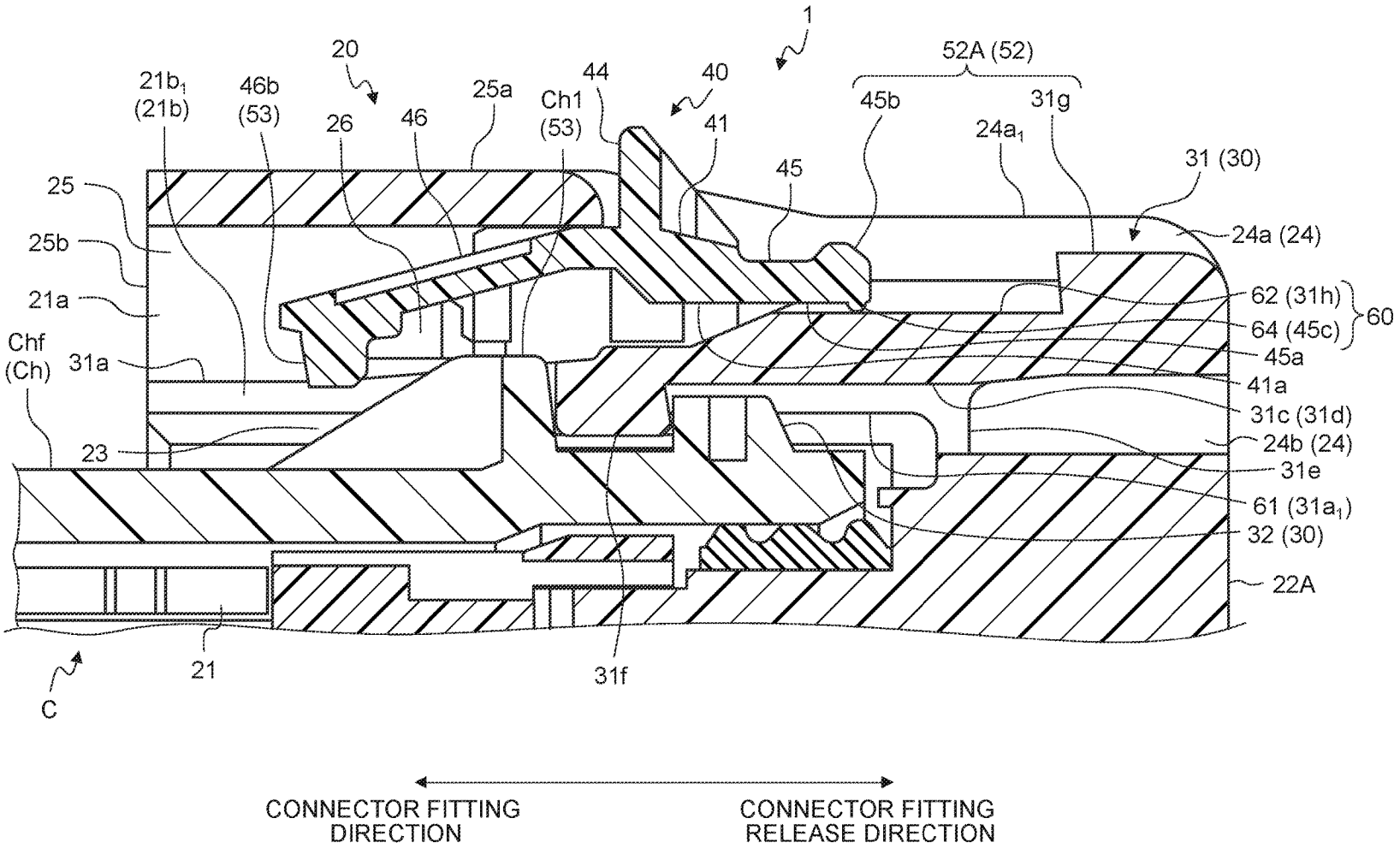
FIG. 6 is a cross-sectional view taken along a line Y-Y of FIG. 4 when the connector and the counterpart connector in the complete fitted state are divided into two parts at the center and is a diagram in which the periphery of the detection member at a main locking position is extracted.

The first holding body 31 includes a second arm connection portion 31*c* which connects the arms 31*a* on the side of the connector fitting release direction (FIGS. 3, 5, and 6). The second arm connection portion 31*c* of this example is disposed to bury a gap between the arms 31*a*. A portion of the first holding body 31 of this example on the side of the connector fitting release direction is formed as a piece portion 31*d* which is mainly formed into a piece body shape by a portion of each arm 31*a* on the side of the connector fitting release direction and the second arm connection portion 31*c*. The piece portion 31*d* is disposed to be separated from the outer wall surface of the terminal storage body 22A. Each arm 31*a* and the second arm connection portion 31*c* are disposed at the gap 21*b* between the free ends of the hood 21, but a notch-shaped space (hereinafter, referred to as "notch") $\mathbf{21}b_1$ which is formed by each arm 31*a* and the second arm connection portion 31*c* is left (FIGS. 1 to 6).

The first holding body 31 is connected to the terminal storage body 22A at the piece portion 31*d*. In this example, a third arm connection portion 31*e* is provided in the middle of each arm 31*a* on the side of the connector fitting release direction (FIGS. 2, 5, and 6). The third arm connection portion 31*e* extends between the arm 31*a* and the outer wall surface of the terminal storage body 22A and connects a portion in the middle of the arm 31*a* on the side of the connector fitting release direction and the outer wall surface of the terminal storage body 22A to each other. A portion of the first holding body 31 on the side of the connector fitting release direction is connected to a terminal storage body 22A through two third arm connection portions 31*e*.

The first holding body 31 includes a protrusion portion 31*f* which is provided at the piece portion 31*d* to protrude toward the outer wall surface of the terminal storage body 22A (FIGS. 2, 5, and 6). The protrusion portion 31*f* is disposed at the annular space portion 23, but is formed to be separated from the outer wall surface of the hood Chf of the counterpart connector C in the complete fitted state (FIG. 6). The protrusion portion 31*f* of this example is provided at the end of the second arm connection portion 31*c* which is located on the side of the connector fitting direction and is a part of the piece portion 31*d*. The protrusion portion 31*f* of this example is formed in a rectangular shape.

Here, the first holding body 31 is formed so that a portion between the first arm connection portion 31*b* and the third arm connection portion 31*e* is flexible and is able to move toward or away from the outer wall surface of the terminal storage body 22A in response to the flexibility therebetween. In the description below, a bending direction (for convenience of description, a direction orthogonal to the connector insertion/extraction direction) therebetween will be referred to as a "flexible direction". The flexible direction may be referred to as a "first orthogonal direction" when viewed from the connector insertion/extraction direction (FIG. 2). Here, each of the first arm connection portions 31*b* and each of the third arm connection portions 31*e* also have flexibility. For this reason, when the protrusion portion 31*f* of the first holding body 31 is pressed in the flexible direction (the outward flexible direction) from the annular space portion 23, a portion between the first arm connection portion 31*b* and the third arm connection portion 31*e* can be deflected. Further, the first holding body 31 can generate the same bending by applying a force to a predetermined position of the piece portion 31*d*. In the first holding body 31 of this example, such bending occurs when a portion on the side of the connector fitting release direction in relation to the third arm connection portion 31*e* in the piece portion 31*d* is pressed down toward the outer wall surface of the terminal storage body 22A. For this reason, in the first holding body 31, the downward pressing portion can be used as an operation portion which is operated by an operator or the like.

The housing 20 of the embodiment is provided with an operation groove 24 which is used to press down the piece portion 31*d* by the operator or the like (FIGS. 1 and 3 to FIG. 6). The piece portion 31*d* is disposed at the operation groove 24 while at least the downward pressing operation portion is exposed to the outside. In the operation groove 24, a space portion which exposes the piece portion 31*d* to the outside is used as an operation space 24*a* used when the operator or the like performs the downward pressing operation. Further, in the operation groove 24, a space is formed between the piece portion 31*d* and the outer wall surface of the terminal storage body 22A and the space becomes a movable space 24*b* of the piece portion 31*d* which moves in accordance with the downward pressing operation (FIGS. 5 and 6). The movable space 24*b* communicates with the annular space portion 23 on the side of the connector fitting direction.

The second holding body 32 is a protrusion body (FIG. 1) which protrudes from the outer wall surface of the hood Chf and is formed and disposed to face the protrusion portion 31*f* in the connector insertion/extraction direction during the connector fitting step. Further, the second holding body 32 is disposed at the outer wall surface of the hood Chf to be located on the side of the connector fitting release direction in relation to the protrusion portion 31*f* in the complete fitted state. The protrusion portion 31*f* and the second holding body 32 may contact each other in the connector insertion/extraction direction or may be separated from each other in the connector insertion/extraction direction in the complete fitted state. Here, when such a gap is formed therebetween, the gap is set so that the complete fitted state is not damaged when the protrusion portion 31*f* and the second holding body 32 contact each other due to a shortened gap. The second holding body 32 of this example is formed in a rectangular shape.

In the holding structure 30, the protrusion portion 31*f* and the second holding body 32 contact each other in accordance with the fitting between the connector 1 and the counterpart connector C during the connector fitting step. When the connector 1 and the counterpart connector C are further fitted to each other after the contact between the protrusion portion 31*f* and the second holding body 32, the second holding body 32 presses the protrusion portion 31*f* in the outward flexible direction to bend the first holding body 31 so that the second holding body 32 gets over the protrusion portion 31*f* to the position of the complete fitted state. Further, the holding structure 30 may move the second holding body 32 to the position of the complete fitted state in such a manner that the operator or the like presses down the operation portion of the piece portion 31*d* so that a portion between the first arm connection portion 31*b* and the third arm connection portion 31*e* of the first holding body 31 is bent in the outward flexible direction along with the protrusion portion 31*f* and the connector 1 and the counterpart connector C are further fitted to each other. At the position of the complete fitted state, the bent first holding body 31 returns to an original position so that the protrusion portion 31*f* and the second holding body 32 face each other in the connector insertion/extraction direction. At that time, in the holding structure 30, since the separation operation between the connector 1 and the counterpart connector C is suppressed, the connectors are maintained in the complete fitted state.

Further, when the operator or the like presses down the operation portion of the piece portion 31*d* in the complete fitted state so that a portion between the first arm connection portion 31*b* and the third arm connection portion 31*e* of the first holding body 31 is bent in the outward flexible direction along with the protrusion portion 31*f*, the protrusion portion 31*f* and the second holding body 32 of the holding structure 30 do not face each other in the connector insertion/extraction direction. For this reason, when the piece portion 31*d* of the holding structure 30 is pressed down, the complete fitted state between the connector 1 and the counterpart connector C can be released.

The connector 1 of the embodiment includes a detection member 40 used to determine the fitted state with respect to the counterpart connector C by the operator or the like (FIGS. 1 to 7). The detection member 40 is assembled to the housing 20. The detection member 40 can be moved between the temporary locking position and the main locking position relative to the housing 20. The temporary locking position indicates a position of the detection member 40 with respect to the housing 20 when the fitted state between the connector 1 and the counterpart connector C is the half fitted state (FIG. 5). The temporary locking position of this example is also a position in which the detection member 40 is assembled to the housing 20. For this reason, the temporary locking position also includes a state where the connector 1 and the counterpart connector C are not inserted to each other. The main locking position is the position of the detection member 40 with respect to the housing 20 when the fitted state between the connector 1 and the counterpart connector C is the complete fitted state (FIG. 6). The detection member 40 of this example is movable relative to the housing 20 in the connector insertion/extraction direction and reaches the main locking position by the relative movement from the temporary locking position in the connector fitting direction. The operator or the like detects a state where the connector 1 and the counterpart connector C are in the complete fitted state when the detection member 40 is relatively movable to the main locking position and detects a state where the connector 1 and the counterpart connector C are in the half fitted state when the detection member 40 is not relatively movable to the main locking position.

The detection member 40 is disposed at the outside of the housing 20 in relation to the first holding body 31 and is assembled to the housing 20 so that at least a portion on the side of the connector fitting release direction is disposed at the operation space 24*a* of the operation groove 24. Thus, a portion on the side of at least the connector fitting release direction of the detection member 40 in the operation space 24*a* is exposed to the outside. In the connector 1 of the embodiment, the operation space 24*a* may be a space which is used for the relative movement operation of the detection member 40. For this reason, a portion on the side of the connector fitting release direction in the detection member 40 is used as an operation portion for the relative movement operation.

The detection member 40 of this example includes a base body 41 and various components are provided around the base body 41 as below (FIGS. 1, 3, and 5 to FIG. 7). The base body 41 is disposed to be separated from the piece portion 31*d* of the first holding body 31 after the detection member 40 is assembled to the housing 20. The base body 41 may be molded as, for example, a rectangular piece body so that one flat surface 41*a* (FIGS. 5 to 7) faces the piece portion 31*d* in the first orthogonal direction (the flexible direction) and the piece body may be provided with various notches or grooves. In the detection member 40 of this example, the base body 41 is disposed in the operation space 24*a* at the temporary locking position.

Figure 7:
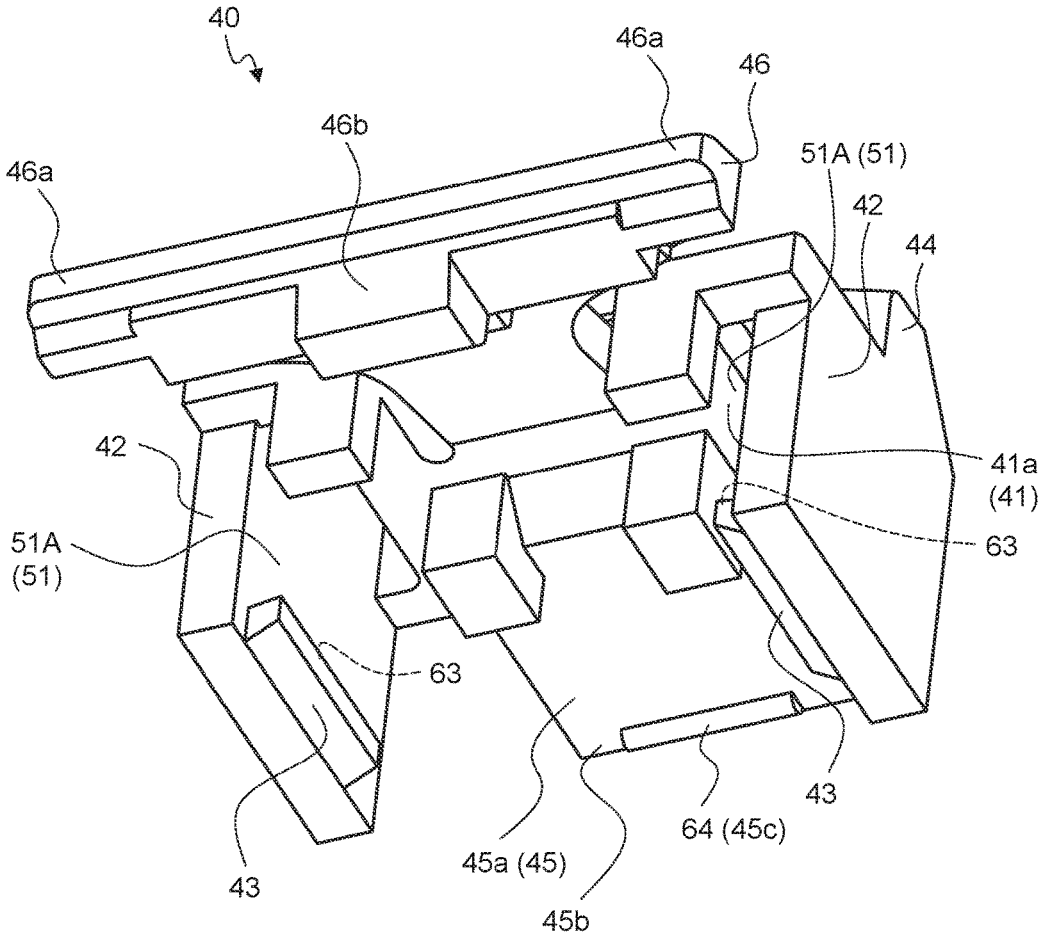
FIG. 7 is a perspective view illustrating the detection member of the embodiment.

A guide structure 51 is provided between the detection member 40 and the housing 20 to guide the movement of the detection member 40 relative to the housing 20 in the connector insertion/extraction direction between the temporary locking position and the main locking position (FIGS. 5 and 7). The guide structure 51 of this example is used to guide the detection member 40 and is also used to lock the detection member 40 to the housing 20 so that the assembled detection member 40 is not separated from the housing 20 (a separation in a direction different from the relative movement direction). The guide structure 51 includes a first guide portion which is provided at the detection member 40 and a second guide portion which is provided at the housing 20.

For example, the detection member 40 is assembled to a space component (a wall body or the like) of the housing 20 forming the operation space 24*a* and the guide structure 51 is provided with respect to the space component, so that a movement relative to the space component in the connector insertion/extraction direction can be realized. For example, in the detection member 40, a guide groove is formed at each side wall 24$a_1$ (FIGS. 1 and 3 to FIG. 6) of the operation space 24*a* corresponding to the space component and a target guide portion disposed inside the guide groove is provided at the detection member 40 (not illustrated). In this case, the target guide groove becomes the first guide portion of the guide structure 51 and the guide groove becomes the second guide portion of the guide structure 51.

In the embodiment, the detection member 40 is assembled to the first holding body 31 corresponding to the space component and the guide structure 51 is provided between the detection member 40 and the first holding body 31. In the guide structure 51, the detection member 40 is provided with the following guide groove corresponding to the first guide portion and the first holding body 31 is provided with the following target guide portion corresponding to the second guide portion.

The detection member 40 includes a wall body 42 which is formed uprightly from the end on the side of each side wall 24$a_1$ in the base body 41 (FIGS. 2, 3, 5, and 7). The wall body 42 is formed to protrude the outer wall surface of the terminal storage body 22A from the end of the base body 41 after the detection member 40 is assembled to the first holding body 31. The wall body 42 of this example is formed in a rectangular piece body shape and is formed to be suspended from the end of the base body 41 toward the outer wall surface of the terminal storage body 22A. Here, in the housing 20 of this example, a gap is formed between the first holding body 31 and each side wall 24$a_1$. The wall body 42 is formed to pass through the gap so that the protruding free end protrudes toward the outer wall surface of the terminal storage body 22A in relation to the piece portion 31*d* of the first holding body 31. For this reason, the wall bodies 42 face each other with the piece portion 31*d* interposed therebetween. In the assembled detection member 40, each wall body 42 is disposed on the side of the connector fitting direction in relation to the third arm connection portion 31*e*.

Each wall body 42 is provided with a protrusion body 43 which protrudes toward the counterpart wall body 42 from the free end side (FIGS. 2, 5, and 7). In the detection member 40, each protrusion body 43 extends in the connector insertion/extraction direction. For this reason, the end of the detection member 40 on the side of the side wall 24$a_1$ is provided with a groove which follows the connector insertion/extraction direction and is surrounded by the base body 41, the wall body 42, and the protrusion body 43. In the detection member 40, the groove becomes a guide groove 51A which is the first guide portion of the guide structure 51 (FIG. 7). When the detection member 40 is assembled to the first holding body 31, each arm 31*a* of the first holding body 31 is accommodated in the guide groove 51A of the detection member 40. That is, the arm 31*a* of the first holding body 31 becomes a target guide portion which is the second guide portion of the guide structure 51. The detection member 40 is held by each arm 31*a* on the side of the connector fitting direction in relation to the third arm connection portion 31*e*.

Since the guide structure 51 has the above-described configuration, the guide structure can guide the movement of the detection member 40 when the detection member 40 moves relative to the first holding body 31 in the connector insertion/extraction direction and can suppress the separation of the detection member 40 from the first holding body 31 (a separation in a direction different from the relative movement direction).

The detection member 40 is provided with an operation body 44 which is used when the relative movement is performed by the operator or the like (FIGS. 1 to 7). The operation body 44 protrudes from the base body 41 in a direction opposite to the wall body 42 in the operation space 24*a*. The operator or the like moves the detection member 40 relative to the first holding body 31 by pressing and pulling the operation body 44 in the connector insertion/extraction direction. The operation body 44 protrudes outward in relation to a wall portion 25*a* of the housing 20.

Figure 8:
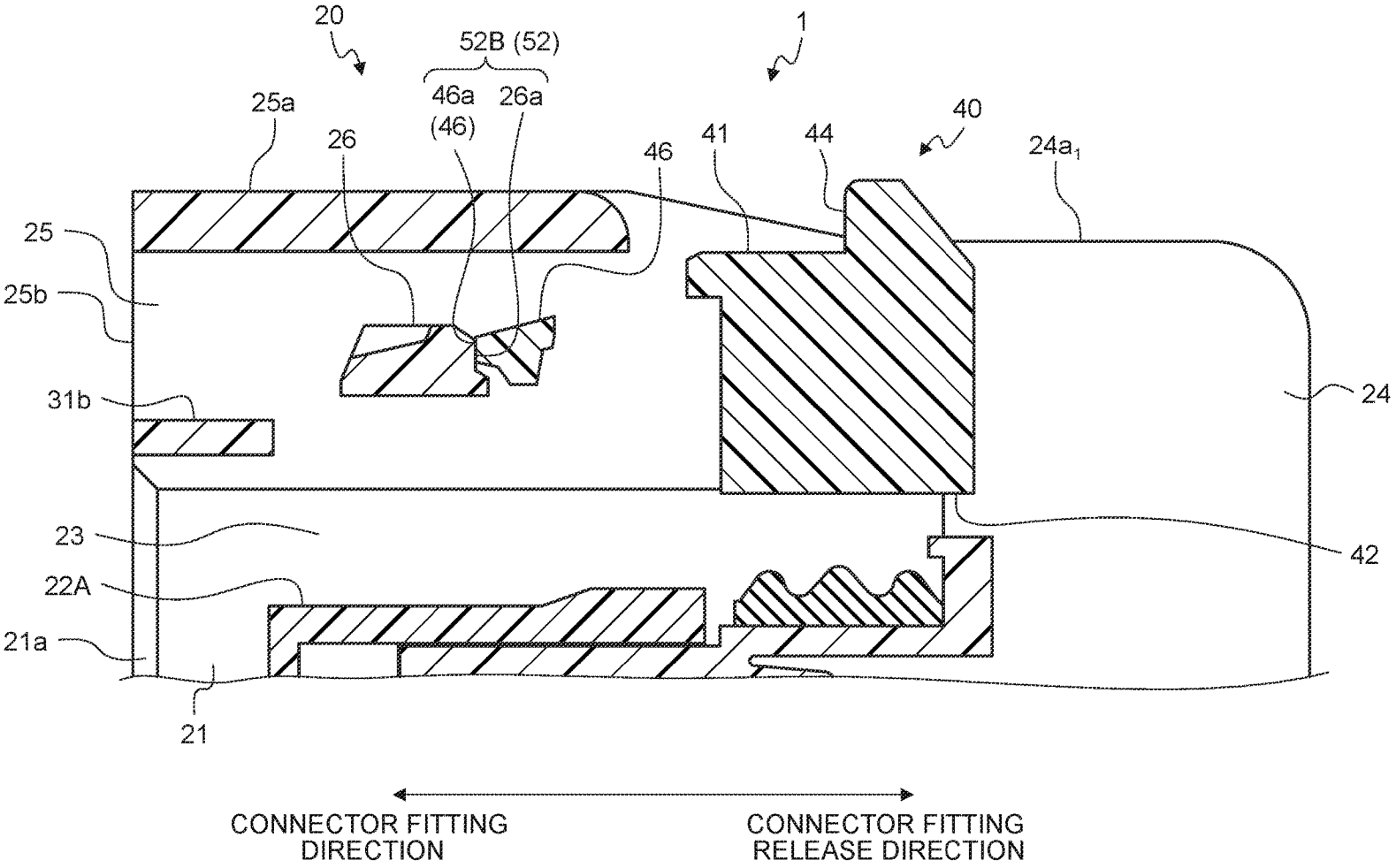
FIG. 8 is a cross-sectional view taken along a line Z-Z of FIG. 2 and is a diagram in which the periphery of the detection member at the temporary locking position is extracted.

A temporary locking structure 52 is provided between the detection member 40 and the housing 20 to lock the movement of the detection member 40 relative to the housing 20 in the relative movement direction (the connector insertion/extraction direction) at the temporary locking position (FIGS. 5, 6, and 8). The temporary locking structure 52 is largely divided into a first temporary locking structure 52A which locks the movement of the detection member 40 in the connector fitting release direction and a second temporary locking structure 52B which locks the movement of the detection member 40 in the connector fitting direction.

First, the first temporary locking structure 52A will be described. The detection member 40 of the embodiment includes a first target locking body 45 which protrudes in the connector fitting release direction from the end of the base body 41 on the side of the connector fitting release direction (FIGS. 1 and 3 to FIG. 7). The first target locking body 45 of this example is formed in a piece body shape and one flat surface 45*a* faces the piece portion 31*d* of the first holding body 31 in the first orthogonal direction (the flexible direction) with a gap interposed therebetween. The first holding body 31 of this example is provided with a locking portion 31*g* which protrudes from the piece portion 31*d* toward the operation space 24*a* (FIGS. 1 and 3 to FIG. 6). The locking portion 31*g* is disposed on the side of the connector fitting release direction in relation to the first target locking body 45 and faces the end of the first target locking body 45 on the side of the connector fitting release direction in the connector insertion/extraction direction. Here, the end of the first target locking body 45 on the side of the connector fitting release direction is used as a target locking portion 45*b* and the movement of the target locking portion 45*b* in the connector fitting release direction can be locked by the locking portion 31*g* (FIG. 6). In the first temporary locking structure 52A, the movement of the detection member 40 relative to the first holding body 31 (the housing 20) in the connector fitting release direction at the temporary locking position is locked by the locking portion 31*g* and the target locking portion 45*b*. The locking portion 31*g* and the target locking portion 45*b* may contact each other in the connector insertion/extraction direction or may be separated from each other in the connector insertion/extraction direction when the detection member 40 is at the temporary locking position.

Next, the second temporary locking structure 52B will be described. The detection member 40 of the embodiment includes a second target locking body 46 which protrudes in the connector fitting direction from the end of the base body 41 on the side of the connector fitting direction (FIGS. 2, 3, and 5 to FIG. 7). The second target locking body 46 of this example is formed in a flat plate shape and protrudes obliquely from the base body 41 toward the outer wall surface of the terminal storage body 22A in the connector fitting direction.

Here, the housing 20 of this example is provided with a storage space 25 which accommodates the second target locking body 46 (FIGS. 1 to 6). The storage space 25 is disposed on the side of the connector fitting direction in relation to the operation space 24*a* and communicates with a portion of the operation space 24*a* on the side of the connector fitting direction. In the storage space 25 of this example, each arm 31*a* of the first holding body 31 is formed in a rectangular shape at one of four wall portions. In addition to the wall portion, the storage space 25 includes a rectangular wall portion 25*a* which faces the opposite side of the annular space portion 23 in each arm 31*a* and two side wall portions 25*b* which connect the free end of the hood 21 connected to the first arm connection portion 31*b* to the end of the wall portion 25*a* on the side of the side wall 24$a_1$. The wall portion 25*a* forms a part of the outer wall of the housing 20. The side wall portions 25*b* face each other in a direction orthogonal to the connector insertion/extraction direction and the first orthogonal direction (the flexible direction). The orthogonal direction will be referred to as a "second orthogonal direction" when viewed from the connector insertion/extraction direction (FIG. 2).

The second target locking body 46 of this example locks the movement in the connector fitting direction in the storage space 25 at the temporary locking position before the insertion of the counterpart connector C. Both ends of the second target locking body 46 in the second orthogonal direction at the end on the side of the connector fitting direction are used as target locking portions 46*a* (FIGS. 2, 3, 7, and 8). Meanwhile, in the storage space 25, a locking body 26 is individually formed uprightly from each side wall portion 25*b* (FIGS. 2, 5, 6, and 8). The locking bodies 26 are disposed to respectively face the target locking portions 46*a* in the connector insertion/extraction direction when the detection member 40 is at the temporary locking position before the insertion of the counterpart connector C. For this reason, here, the end of each locking body 26 on the side of the connector fitting release direction is used as a locking portion 26*a* and the movement of the target locking portion 46*a* in the connector fitting direction can be locked by each locking portion 26*a* (FIG. 8). In the second temporary locking structure 52B, the movement of the detection member 40 relative to the first holding body 31 (the housing 20) in the connector fitting direction is locked by the locking portion 26*a* and the target locking portion 46*a* when the detection member 40 is at the temporary locking position before the insertion of the counterpart connector C. At that time, the locking portion 26*a* and the target locking portion 46*a* may contact each other in the connector insertion/extraction direction or may be separated from each other in the connector insertion/extraction direction.

Figure 9:
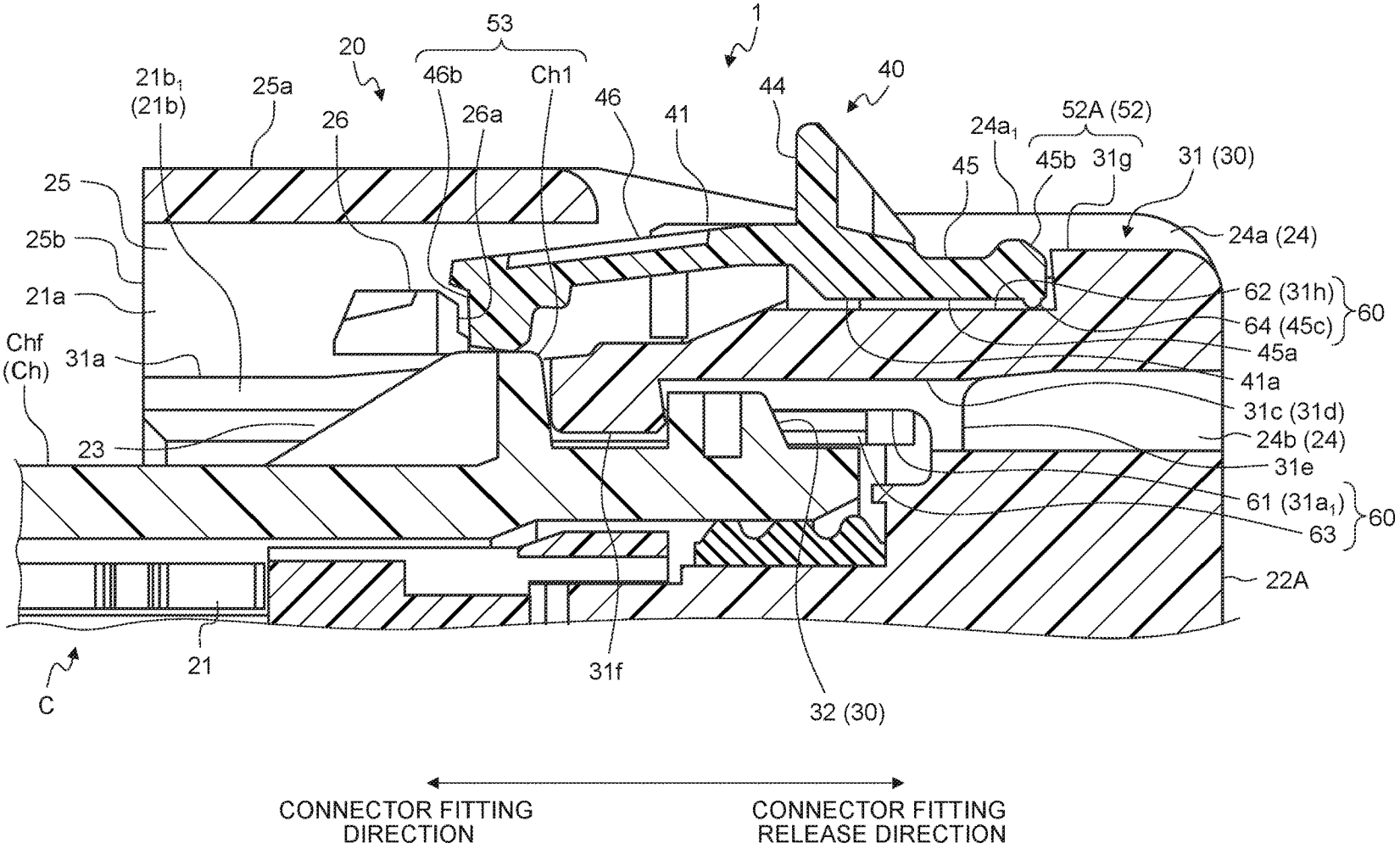
FIG. 9 is a diagram in which the periphery of the detection member located at the temporary locking position before reaching the main locking position of FIG. 6 is extracted.

The connector 1 is provided with a temporary locking release structure 53 which releases the temporary locked state of the detection member 40 at the temporary locking position (FIGS. 6 and 9). The temporary locking release structure 53 is used to allow the movement of the detection member 40 relative to the housing 20 along with the release of the temporary locked state and releases the temporary locked state by bending the second target locking body 46 so that the target locking portion 46*a* gets over the locking body 26 in the connector fitting direction.

In the detection member 40, the second target locking body 46 is provided with a temporary locking release portion 46*b* (FIGS. 3 and 5 to FIGS. 7 and 9). The temporary locking release portion 46*b* is a portion which serves as an operation point of a force used in the temporary locking release operation. In the second target locking body 46 of this example, a rectangular protrusion body which protrudes toward the notch 21$b_1$ is provided at a portion facing the notch 21$b_1$ of the hood 21 at the temporary locking position in the first orthogonal direction (the flexible direction) and the protrusion body is used as the temporary locking release portion 46*b*. In this example, the temporary locking release portion 46*b* is provided between the target locking portions 46*a* at the end of the second target locking body 46 on the side of the connector fitting direction in a portion facing the notch 21$b_1$.

In the detection member 40, when a force is applied in the first orthogonal direction from the notch 21$b_1$ to the temporary locking release portion 46*b*, the temporary locking release portion 46*b* is pressed in the force application direction and the second target locking body 46 is bent about a point near the base body 41 to a position in which the target locking portion 46*a* can get over the locking body 26.

In this example, the counterpart connector C is provided with an operation portion (hereinafter, referred to as a "release operation portion") Ch1 used for the temporary locking release operation (FIGS. 1, 6, and 9) and a force for the temporary locking release operation is applied from the release operation portion Ch1. The release operation portion Ch1 protrudes from the outer wall surface of the hood Chf of the counterpart connector C to be inserted into the notch 21$b_1$ of the hood 21 in the connector fitting step. The release operation portion Ch1 is formed and disposed so that the release operation portion contacts the temporary locking release portion 46*b* in accordance with the fitting between the connector 1 and the counterpart connector C and a force is applied to the temporary locking release portion 46*b* in the first orthogonal direction (the release operation direction in the temporary locked state). Further, the release operation portion Ch1 is formed and disposed so that the temporary locking release portion 46*b* is pressed in the first orthogonal direction by a force generated by the further fitting. Further, the release operation portion Ch1 is formed and disposed so that the second target locking body 46 is pressed to a position in which the target locking portion 46*a* gets over the locking body 26 in the complete fitted state (FIG. 9). For example, the temporary locking release portion 46*b* and the release operation portion Ch1 may be formed so that the locking body 26 and the target locking portion 46*a* do not face each other in the connector insertion/extraction direction. Further, when the locking body 26 and the target locking portion 46*a* face each other in the connector insertion/extraction direction as in this example (FIG. 10), the locking body 26 and the target locking portion 46*a* may be formed so that the target locking portion 46*a* gets over the locking body 26 by inclining a contact portion in the connector insertion/extraction direction through chamfering or the like.

Figure 10:
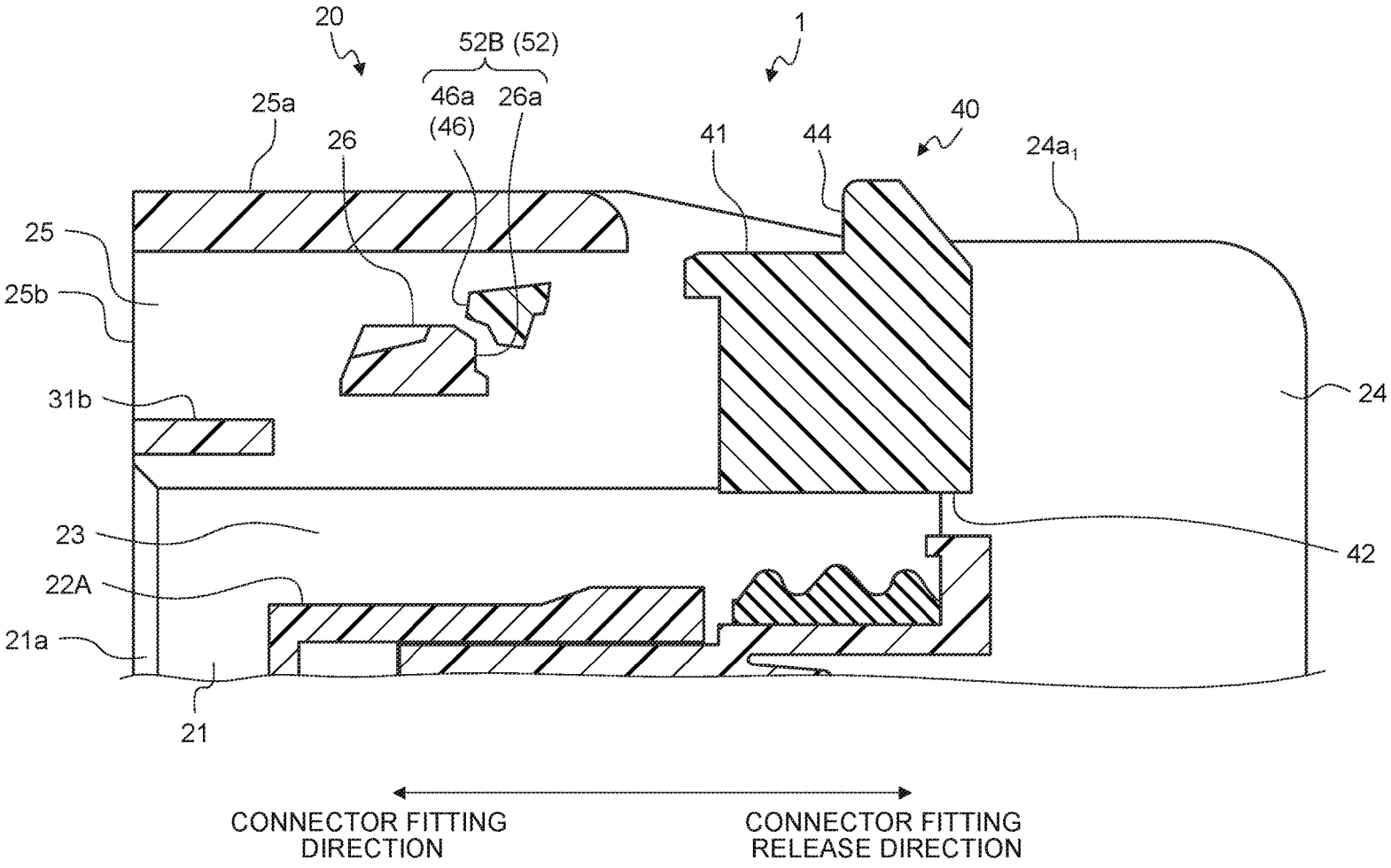
FIG. 10 is a cross-sectional view taken along a line Z-Z of FIG. 2 and is a diagram in which the periphery of the detection member at the temporary locking position is extracted.

The temporary locking release structure 53 includes the temporary locking release portion 46*b* and the release operation portion Ch1. In the temporary locking release structure 53, after the start of the fitting between the counterpart connector C and the connector 1 (FIG. 5) having the detection member 40 assembled thereto, the release operation portion Ch1 is inserted into the notch 21$b_1$ of the hood 21 and the release operation portion Ch1 contacts the temporary locking release portion 46*b* in accordance with the fitting. Then, in the temporary locking release structure 53, the release operation portion Ch1 applies a force to the temporary locking release portion 46*b* in the first orthogonal direction in accordance with the fitting. At that time, in the detection member 40, the second target locking body 46 starts to be bent about a portion near the base body 41. In the detection member 40, when the connector 1 and the counterpart connector C are in the complete fitted state in accordance with the further fitting, the second target locking body 46 is bent relative to the base body 41 to a position where the target locking portion 46*a* gets over the locking body 26 (FIGS. 9 and 10). For this reason, the target locking portion 46*a* can move in the connector fitting direction over the locking portion 26*a*. Thus, the detection member 40 can move from the temporary locking position to the main locking position relative to the housing 20.

Figure 11:
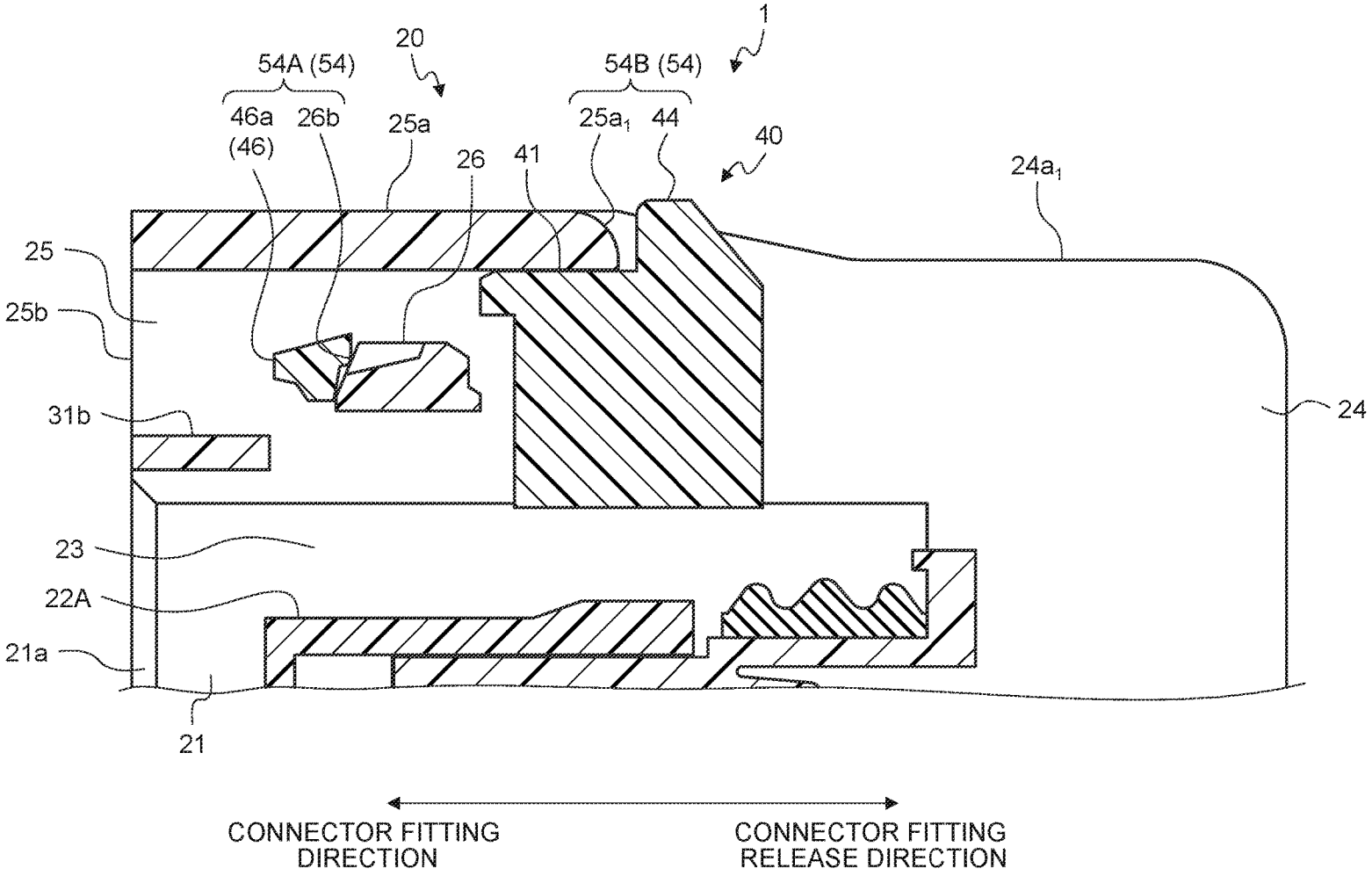
FIG. 11 is a diagram illustrating a state where the detection member of FIG. 10 relatively moves to the main locking position.
Figure 12:
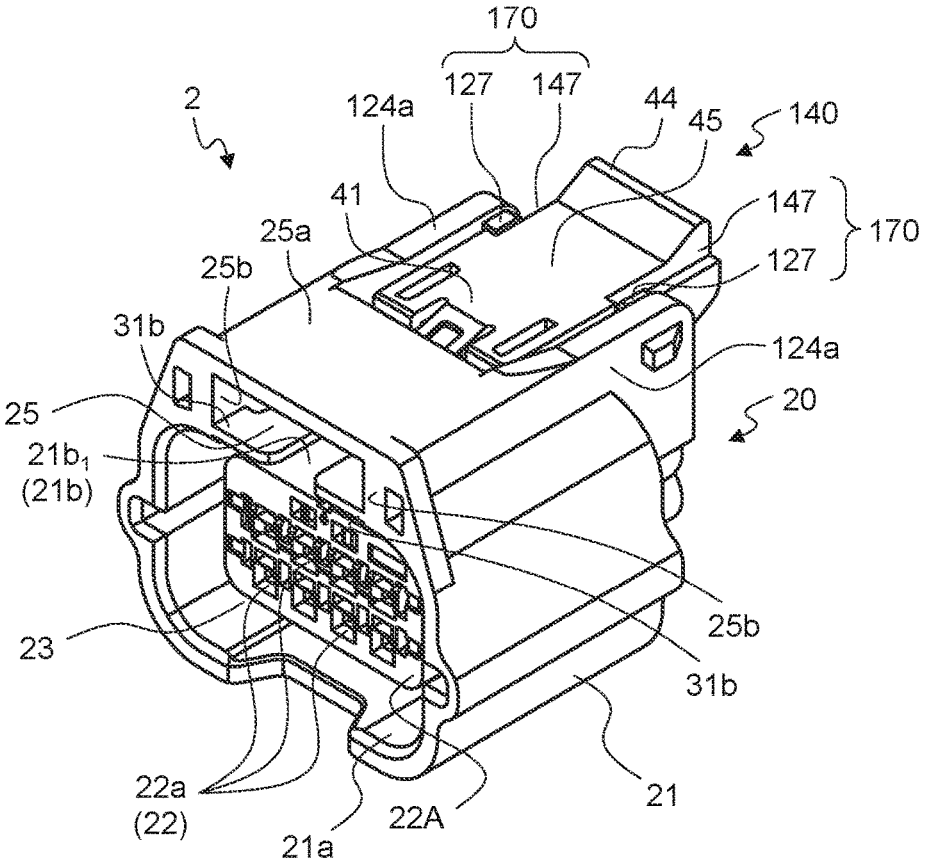
FIG. 12 is a perspective view illustrating a connector of a modified example.
Figure 13:
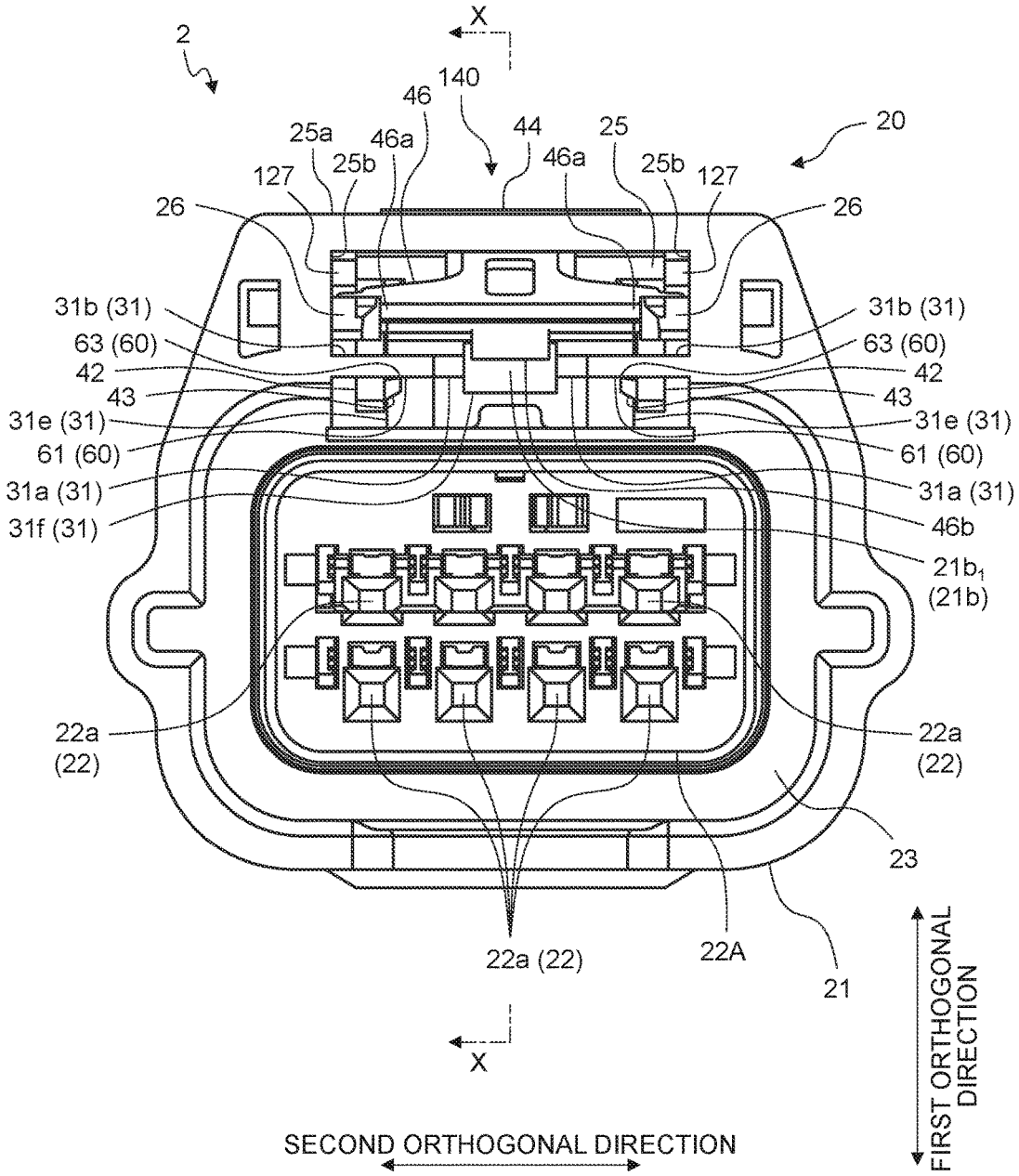
FIG. 13 is a front view illustrating the connector of the modified example when viewed from the counterpart connector.
Figure 14:
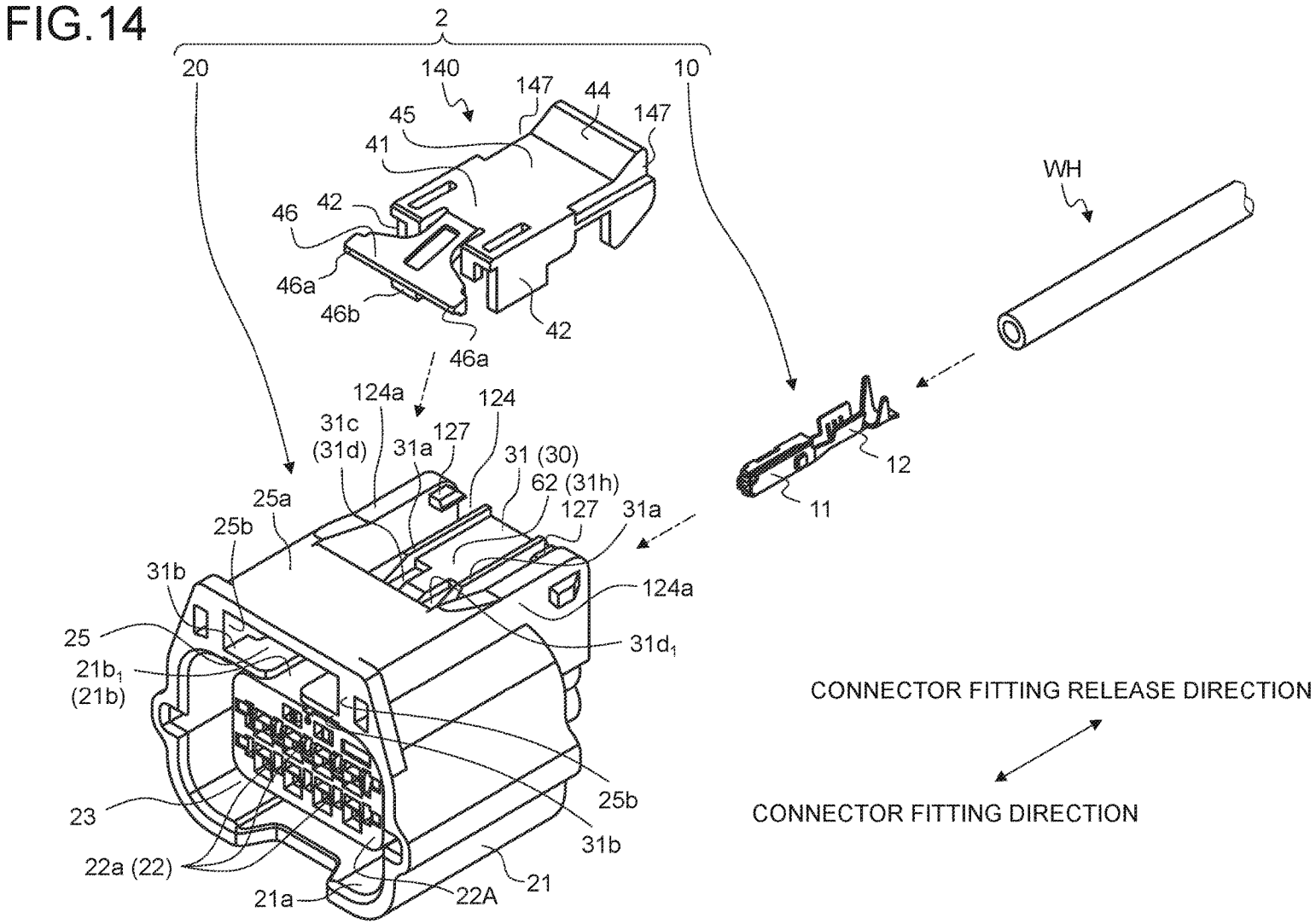
FIG. 14 is an exploded perspective view illustrating the connector of the modified example.
Figure 15:
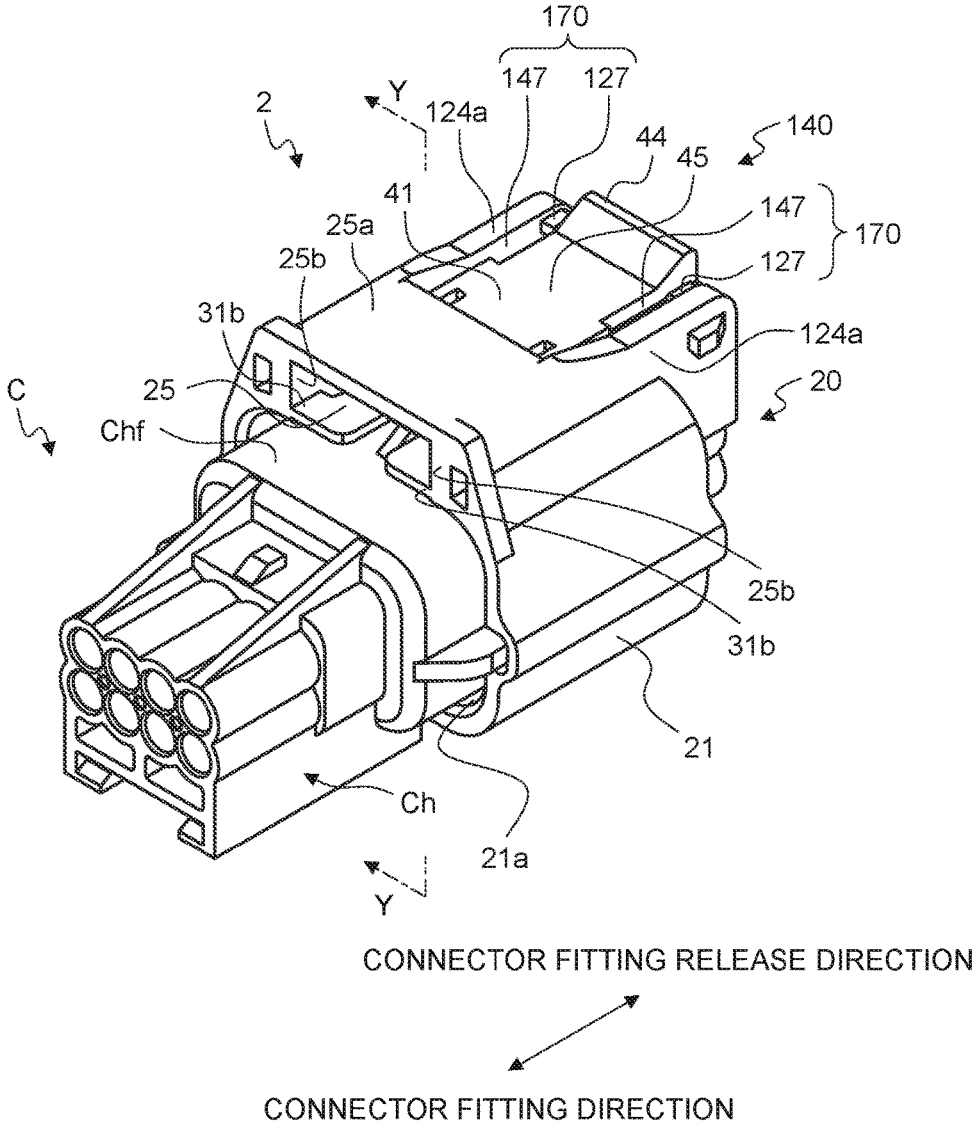
FIG. 15 is a perspective view illustrating the connector of the modified example and illustrates the complete fitted state after the connector is completely fitted to the counterpart connector.
Figure 16:
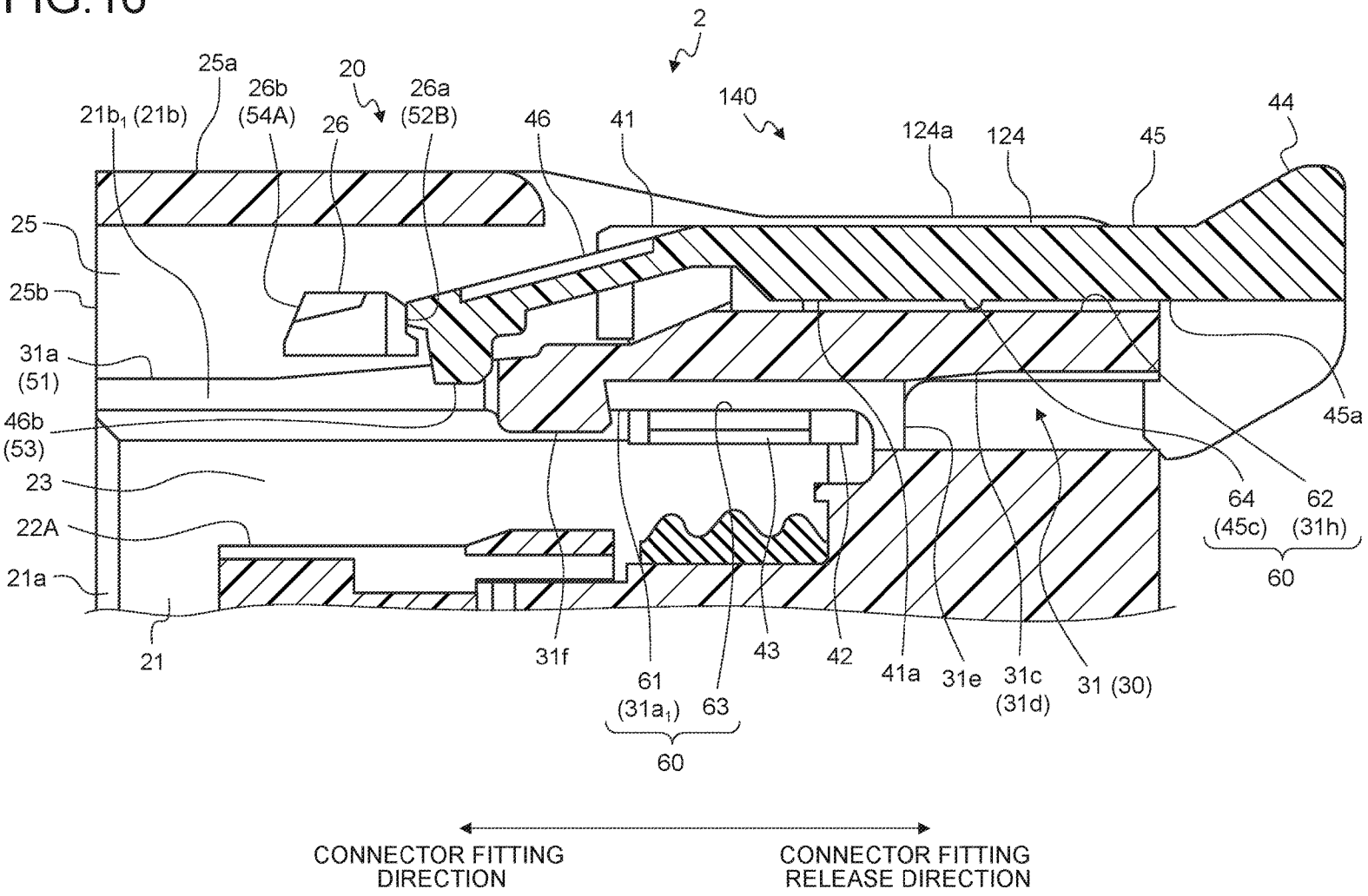
FIG. 16 is a cross-sectional view taken along a line X-X of FIG. 13 and is a diagram in which the periphery of the detection member at the temporary locking position is extracted.

A main locking structure 54 is provided between the detection member 40 and the housing 20 to lock the movement of the detection member 40 relative to the housing 20 in the relative movement direction (the connector insertion/extraction direction) at the main locking position (FIG. 11). The main locking structure 54 is largely divided into a first main locking structure 54A which locks the movement of the detection member 40 in the connector fitting release direction and a second main locking structure 54B which locks the movement of the detection member 40 in the connector fitting direction.

First, the first main locking structure 54A will be described. Since the second target locking body 46 is separated from the release operation portion Ch1 until the detection member 40 moves to the main locking position after the temporary locked state is released, the bending of the second target locking body 46 is gradually released (FIG. 6). Here, when the detection member 40 moves to the main locking position, the target locking portion 46*a* is located on the side of the connector fitting direction in relation to the locking body 26 and the locking body 26 and the target locking portion 46*a* face each other in the connector insertion/extraction direction (FIG. 11). Here, the end of each locking body 26 on the side of the connector fitting direction is used as a locking portion 26*b* and the movement of the target locking portion 46*a* in the connector fitting release direction is locked by each locking portion 26*b*. In the first main locking structure 54A, the movement of the detection member 40 relative to the first holding body 31 (the housing 20) in the connector fitting release direction at the main locking position is locked by the locking portion 26*b* and the target locking portion 46*a*. At that time, the locking portion 26*b* and the target locking portion 46*a* may contact each other in the connector insertion/extraction direction or may be separated from each other in the connector insertion/extraction direction.

Next, the second main locking structure 54B will be described. When the detection member 40 moves relatively from the temporary locking position to the main locking position, the operation body 44 moves toward the wall portion 25*a* of the housing 20 (FIG. 11). When the operation body 44 contacts the wall portion 25*a* in accordance with the relative movement of the detection member 40, there is a possibility that the detection member may not relatively move to the main locking position due to a tolerance variation and an assembly variation of the components. For this reason, the operation body 44 is disposed to have a gap with respect to an end 25$a_1$ on the side of the connector fitting release direction of the wall portion 25*a* at the main locking position in the connector insertion/extraction direction. Meanwhile, when the gap between the operation body 44 and the wall portion 25*a* at the main locking position is narrowed, the movement of the operation body 44 in the connector fitting direction can be locked by the end 25$a_1$ of the wall portion 25*a*. Thus, here, the gap between the end 25$a_1$ of the wall portion 25*a* and the operation body 44 at the main locking position is set within a range in which a determination that the detection member 40 is located at the main locking position is not disturbed even when the gap is narrowed to be zero. The operation body 44 and the wall portion 25*a* are formed and disposed based on the set gap. Accordingly, here, the second main locking structure 54B is formed by the operation body 44 and the end 25$a_1$ of the wall portion 25*a* to lock the movement of the detection member 40 at the main locking position in the connector fitting direction.

Incidentally, in the connector 1, when there is a backlash in the first orthogonal direction (which is the flexible direction and corresponds to the temporary locked state release operation direction using the release operation portion Ch1 and the opposite direction) between the detection member 40 and the housing 20 (that is, a gap between the arm 31*a* of the housing 20 and the guide groove of the detection member 40 surrounded by the base body 41, the wall body 42, and the protrusion body 43) in the guide structure 51, there is a possibility that the detection member 40 may be displaced relative to the housing 20 from the normal posture. The normal posture is a posture of the detection member 40 relative to the housing 20 capable of regulating the relative movement in the connector insertion/extraction direction using the temporary locking structure 52 when the detection member 40 is at the temporary locked state. Further, the normal posture is also a posture in which the detection member 40 can be moved relative to the housing 20 at the main locking position when the temporary locked state of the detection member 40 is released. Further, the normal posture is also a posture of the detection member 40 relative to the housing 20 capable of regulating the relative movement in the connector insertion/extraction direction using the main locking structure 54 when the detection member 40 is in the main locked state.

For example, when the detection member 40 is displaced relative to the housing 20 from the normal posture at the temporary locking position, the temporary locked state is released regardless of the complete fitted state between the connector 1 and the counterpart connector C. Thus, there is a possibility that the detection member 40 may relatively move to the main locking position. Further, when the displacement of the detection member 40 occurs at the temporary locking position, the release operation portion Ch1 of the counterpart connector C collides with the temporary locking release portion 46*b* in the connector insertion/extraction direction. Thus, there is a possibility that the counterpart connector C may be inserted to the position of the complete fitted state. Further, when the displacement of the detection member 40 occurs at the main locking position, the main locked state is released and thus the detection member 40 is displaced toward the temporary locking position. Thus, there is a possibility that the complete fitted state may not be ensured regardless of the complete fitted state between the connector 1 and the counterpart connector C. In this way, there is a concern that the backlash between the detection member 40 and the housing 20 in the first orthogonal direction may degrade the detection accuracy of the fitted state between the connector 1 and the counterpart connector C.

Here, the connector 1 of the embodiment is provided with a backlash elimination structure 60 which sets the backlash amount between the detection member 40 and the housing 20 in the first orthogonal direction to be zero (FIGS. 2, 5, 6, and 9).

The backlash elimination structure 60 includes first and second target sliding portions 61 and 62 which are provided in the housing 20 and first and second contact points 63 and 64 which are provided in the detection member 40. In the housing 20, the second target sliding portion 62 is disposed on the side of the temporary locked state release operation direction in relation to the first target sliding portion 61. In the backlash elimination structure 60, the first contact point 63 is disposed on the side opposite to the temporary locked state release operation direction in the first target sliding portion 61 and the first contact point 63 is brought into contact with the first target sliding portion 61 in the release operation direction. The contact type may be any one of a point contact, a line contact, and a plane contact. Further, in the backlash elimination structure 60, the second contact point 64 is disposed on the side of the temporary locked state release operation direction in the second target sliding portion 62 and the second contact point 64 is brought into contact with the second target sliding portion 62 in a direction opposite to the release operation direction. The contact type may be any one of a point contact, a line contact, and a plane contact. In the backlash elimination structure 60, when the detection member 40 is moved between the temporary locking position and the main locking position relative to the housing 20, the first contact point 63 is slid along the first target sliding portion 61 and the second contact point 64 is slid along the second target sliding portion 62. Thus, the first and second target sliding portions 61 and 62 are formed at the housing 20 to follow the connector insertion/extraction direction. Further, the first contact point 63 and the second contact point 64 are disposed to be displaced from each other in the connector insertion/extraction direction. Meanwhile, the detection member 40 can allow the first contact point 63 to continuously contact the first target sliding portion 61 at least between the temporary locking position and the main locking position, but when a force is applied to the first contact point 63 in a direction opposite to the temporary locked state release operation direction, the first contact point 63 moves in that direction relative to the housing 20 so that the first contact point 63 is separated from the first target sliding portion 61. Accordingly, since the detection member 40 can keep sandwiching the first target sliding portion 61 and the second target sliding portion 62 of the housing 20 by the first contact point 63 and the second contact point 64 between the temporary locking position and the main locking position, the backlash amount with respect to the housing 20 in the first orthogonal direction becomes zero and thus the normal posture relative to the housing 20 can be kept.

In this example, the first holding body 31 is provided with the first target sliding portion 61 and the protrusion body 43 is provided with the first contact point 63 (FIGS. 2 and 5).

For example, the first target sliding portion 61 is provided at the wall portion (the first wall portion) opposite to the temporary locked state release operation direction in the piece portion 31*d* of the first holding body 31. Here, at least a part of an end 31$a_1$ opposite to the temporary locked state release operation direction in the arm 31*a* is used as the first target sliding portion 61. The first target sliding portion 61 is provided in each arm 31*a*. In the end 31$a_1$ of the arm 31*a*, a portion which is used as at least the first target sliding portion 61 is formed as a flat surface orthogonal to the first orthogonal direction (the temporary locked state release operation direction and the direction opposite thereto). In the first target sliding portion 61 of this example, the orthogonal flat surface extends in the connector insertion/extraction direction so as to keep the contact of the first contact point 63 at least between the temporary locking position and the main locking position.

The protrusion body 43 of the detection member 40 faces the end 31$a_1$ of the arm 31*a* in the first orthogonal direction. For this reason, the first contact point 63 is provided at the protrusion body 43. Specifically, in this example, the end of the protrusion body 43 on the side of the temporary locked state release operation direction is used as the first contact point 63. The first contact point 63 is provided at each protrusion body 43. Thus, in the end 31$a_1$ of the arm 31*a*, the first target sliding portion 61 is set within the relative movement range at least between the temporary locking position and the main locking position of the first contact point 63. That is, in the housing 20 and the detection member 40 of this example, the first target sliding portion 61 of the arm 31*a* and the first contact point 63 of the protrusion body 43 are formed and disposed so that the first contact point 63 continuously contacts the first target sliding portion 61 at least between the temporary locking position and the main locking position.

Further, in this example, the first holding body 31 is provided with the second target sliding portion 62 and the first target locking body 45 is provided with the second contact point 64 (FIGS. 5, 6, and 9).

The second target sliding portion 62 is provided at a wall portion (a second wall portion) 31$d_1$ (FIG. 3) of the piece portion 31*d* of the first holding body 31 on the side of the temporary locked state release operation direction. In this example, the wall portion 31$d_1$ is provided with a target sliding body 31*h* which protrudes in the release operation direction (FIG. 3). The second target sliding portion 62 is provided at the end of the target sliding body 31*h* on the side of the release operation direction. Then, the target sliding body 31*h* is formed so that a portion which is used as at least the second target sliding portion 62 at the end on the side of the release operation direction becomes a flat surface orthogonal to the first orthogonal direction. In the second target sliding portion 62 of this example, the orthogonal flat surface extends in the connector insertion/extraction direction so as to keep the contact of the second contact point 64 at least between the temporary locking position and the main locking position.

The end opposite to the temporary locked state release operation direction of the detection member 40 (that is, one flat surface 45*a* of the first target locking body 45) faces the end of the target sliding body 31*h* on the side of the release operation direction in the first orthogonal direction. For this reason, the second contact point 64 is provided on the side of the flat surface 45*a* of the first target locking body 45. Specifically, in this example, a contact body 45*c* is provided to be continuous to the first target locking body 45 by the flat surface 45*a* (FIG. 5 to FIGS. 7 and 9) and the contact body 45*c* is provided with the second contact point 64. The contact body 45*c* of this example is a protrusion body which protrudes in a direction opposite to the release operation direction from the flat surface 45*a* and the end opposite to the release operation direction is used as the second contact point 64. The contact body 45*c* of this example is disposed at the end of the flat surface 45*a* on the side of the connector fitting release direction. Further, the contact body 45*c* of this example is formed in a pillar shape extending in the second orthogonal direction and is swollen so that the end opposite to the release operation direction becomes an arcuate surface. In the end of the target sliding body 31*h* on the side of the release operation direction, the second target sliding portion 62 is set within the relative movement range at least between the temporary locking position and the main locking position of the second contact point 64. That is, in the housing 20 and the detection member 40 of this example, the second target sliding portion 62 of the target sliding body 31*h* and the second contact point 64 of the first target locking body 45 are formed and disposed so that the second contact point 64 continuously contacts the second target sliding portion 62 at least between the temporary locking position and the main locking position.

Further, the end of the first target locking body 45 on the side of the connector fitting release direction may be used as the second contact point 64. In this case, the first target locking body 45 protrudes obliquely from the end of the base body 41 on the side of the connector fitting release direction toward the end of the target sliding body 31*h* on the side of the release operation direction (the second target sliding portion 62) in the connector fitting release direction and the protruding end (that is, the end on the side of the connector fitting release direction) contacts the second target sliding portion 62 between the temporary locking position and the main locking position. Even in this configuration, the second target sliding portion 62 of the target sliding body 31*h* and the second contact point 64 of the first target locking body 45 can be formed so that the second contact point 64 continuously contacts the second target sliding portion 62 between the temporary locking position and the main locking position.

In the detection member 40 of this example, since the first contact points 63 at two points can continuously contact the first target sliding portions 61 at two points and the second contact point 64 can continuously contact the second target sliding portion 62 between the temporary locking position and the main locking position, each end of the first holding body 31 on the side of the second orthogonal direction can be continuously sandwiched by the first contact point 63 and the second contact point 64. Thus, since the backlash amount with respect to the housing 20 in the first orthogonal direction becomes zero between the temporary locking position and the main locking position, the detection member 40 can keep the normal posture with respect to the housing 20. Thus, it is possible to improve the detection accuracy of the fitted state between the connector 1 and the counterpart connector C.

Here, in the detection member 40, the base body 41 is disposed at the first contact point 63 on the side of the temporary locked state release operation direction and is disposed in the release operation direction to be separated from the wall portion 31$d_1$ of the piece portion 31*d* on the side of the release operation direction (the wall portion located on the side of the release operation direction in relation to the first target sliding portion 61 of the housing 20). Further, in the detection member 40, the wall body 42 can be used as a connection body (a first connection body) connecting the base body 41 and the first contact point 63 to each other. As described above, the wall bodies 42 (the first connection bodies) are disposed to be separated from each other in the second orthogonal direction of the base body 41 and respectively include the first contact points 63. Further, in the detection member 40, the first target locking body 45 is disposed in the release operation direction to be separated from the wall portion 31$d_1$ of the piece portion 31*d* on the side of the release operation direction and can be used as a connection body (a second connection body) connecting the base body 41 and the second contact point 64 to each other.

In the connector 1 of the embodiment, the detection member 40 has flexibility so that the base body 41 moves in a direction opposite to the release operation direction to approach the wall portion 31$d_1$ of the piece portion 31*d*. For example, the operator or the like can press the base body 41 through the operation body 44 in that direction. In the detection member 40, the protrusion body 43 also moves in the same direction relative to the piece portion 31*d* (the housing 20) along with each wall body 42 in response to the movement of the base body 41 relative to the piece portion 31*d* (the housing 20). In the detection member 40 of this example, when the base body 41 and the operation body 44 are pressed, a gap between the flat surface 41*a* of the base body 41 and the wall portion 31$d_1$ of the piece portion 31*d* is narrowed and a gap between the flat surface 45*a* of the first target locking body 45 and the wall portion 31$d_1$ of the piece portion 31*d* is also narrowed, so that the protrusion body 43 cannot move relative to the piece portion 31*d* (the housing 20). Meanwhile, the detection member 40 returns to an original shape before the operation when the pressing operation is stopped. Thus, the detection member 40 and the first holding body 31 are formed so that the first contact point 63 of the protrusion body 43 contacts the first target sliding portion 61 of the arm 31*a* of the piece portion 31*d* after the stop of the pressing operation even when a tolerance variation and an assembly variation of the component become maximal.

For example, in the detection member 40 of this example, the base body 41 and the operation body 44 are pressed toward the wall portion 31$d_1$ of the piece portion 31*d* at the time point in which the second target locking body 46 starts to be inserted into the storage space 25 while moving from the second target locking body 46 toward the housing 20 so that the second target locking body 46 substantially enters the storage space 25. The base body 41 and the operation body 44 are pressed so that each protrusion body 43 gets over the piece portion 31*d* to move from the operation space 24*a* of the operation groove 24 toward the movable space 24*b*.

Here, the detection member 40 is set so that the piece portion 31*d* (the arm 31*a*) is sandwiched by the first contact point 63 of the protrusion body 43 and the second contact point 64 of the first target locking body 45 in the backlash elimination structure 60. For this reason, for example, there is a possibility that both protrusion bodies 43 cannot get over the piece portion 31*d*, the detection member 40 cannot be assembled to the housing 20, and a gap is formed between the first target sliding portion 61 and the first contact point 63 so that the piece portion 31*d* (the arm 31*a*) cannot be sandwiched due to a tolerance variation and an assembly variation of the components.

However, the detection member 40 of the embodiment can be bent as described above. For this reason, when the base body 41 and the operation body 44 are pressed inward, the detection member 40 is bent so that a gap formed at the flat surface 41*a* of the base body 41 and the flat surface 45*a* of the first target locking body 45 with respect to the wall portion $\mathbf{31}d_1$ of the piece portion 31*d* is narrowed while the second contact point 64 contacts the second target sliding portion 62, so that the first contact point 63 of the protrusion body 43 entering the movable space 24*b* is separated from the first target sliding portion 61 of the arm 31*a* of the piece portion 31*d*. Then, when the pressing operation of the base body 41 and the operation body 44 is stopped, the detection member 40 returns to an original position before the operation so that the first contact point 63 contacts the first target sliding portion 61. Accordingly, the detection member 40 can be assembled to the first holding body 31 so that the piece portion 31*d* (the arm 31*a*) is sandwiched by the first contact point 63 of each protrusion body 43 and the second contact point 64 of the first target locking body 45.

In this way, the connector 1 of the embodiment can set the backlash amount in the first orthogonal direction between the detection member 40 and the housing 20 to be zero without degrading the workability of assembling the detection member 40 to the housing 20. Thus, the connector 1 can improve the detection accuracy of the fitted state between the connector 1 and the counterpart connector C by using the detection member 40 while ensuring simple assembling workability of the detection member 40.

Modified Examples

A connector 2 of a modified example is different from the connector 1 of the embodiment as below. Further, in the modified example, for convenience of description, the same reference numerals will be given to those having the same functions as those of the connector 1 of the embodiment although those have slightly different shapes, and the description thereof will be appropriately omitted.

The connector 2 of the modified example includes the terminal 10, the housing 20, and a detection member 140 similarly to the connector 1 of the embodiment (FIGS. 12 to 19). The terminal 10 similar to that of the connector 1 of the embodiment is used. Meanwhile, the housing 20 and the detection member 140 are modified as below compared to the connector 1 of the embodiment.

Similarly to the housing 20 of the embodiment, the housing 20 includes the hood 21 and the terminal storage body 22A (the plurality of terminal storage rooms 22) having the annular space portion 23 formed therebetween and the fitted state with respect to the counterpart connector C is maintained by the holding structure 30. Here, the housing 20 of the modified example appropriately changes the shape of the housing 20 of the embodiment in accordance with the shape of the detection member 140.

Similarly to the connector 1 of the embodiment, the detection member 140 is disposed at an operation groove 124 of the housing 20 and the storage space 25. The detection member 140 performs a relative operation with respect to the operation groove 124 in the connector insertion/extraction direction through the operation body 44 as below. Further, each side wall portion 25*b* of the storage space 25 is provided with the locking body 26 similarly to the housing 20 of the embodiment.

The detection member 140 includes the base body 41, the wall body 42, the protrusion body 43, the first target locking body 45, and the second target locking body 46 disposed similarly to the detection member 40 of the embodiment and is assembled to the housing 20 similarly to the detection member 40 of the embodiment. Here, the detection member 140 is formed so that the operation body 44 is disposed at the protruding end of the first target locking body 45.

Even in the connector 2 of the modified example, a gap between the detection member 140 and the housing 20 is provided with the guide structure 51 using each arm 31*a* of the first holding body 31 and the guide groove 51A (FIG. 18) surrounded by the base body 41, the wall body 42, and the protrusion body 43 similarly to the connector 1 of the embodiment. Thus, the movement of the detection member 140 in the connector insertion/extraction direction relative to the housing 20 is guided between the temporary locking position and the main locking position similarly to the connector 1 of the embodiment.

Further, similarly to the connector 1 of the embodiment, in the connector 2 of the modified example, the second temporary locking structure 52B using the locking portion 26*a* (FIG. 16) of the locking body 26 and the target locking portion 46*a* (FIG. 18) of the second target locking body 46 is provided between the detection member 140 and the housing 20. Thus, the movement of the detection member 140 in the connector fitting direction is locked at the temporary locking position.

Further, similarly to the connector 1 of the embodiment, in the connector 2 of the modified example, the temporary locking release structure 53 using the release operation portion Ch1 (FIG. 17) of the counterpart connector C and the temporary locking release portion 46*b* (FIGS. 16 and 17) of the second target locking body 46 is provided. Thus, since the temporary locked state is released when the connector 1 and the counterpart connector C are in the complete fitted state, the detection member 140 can move relative to the housing 20 from the temporary locking position to the main locking position.

Further, similarly to the connector 1 of the embodiment, in the connector 2 of the modified example, the first main locking structure 54A using the locking portion 26*b* (FIG. 16) of the locking body 26 and the target locking portion 46*a* (FIG. 18) of the second target locking body 46 is provided. Thus, the movement of the detection member 140 in the connector fitting release direction is locked at the main locking position.

Further, even in the connector 2 of the modified example, it is desirable to provide the first temporary locking structure which locks the movement of the detection member 140 in the connector fitting release direction at the temporary locking position or the second main locking structure which locks the movement of the detection member 140 in the connector fitting direction at the main locking position between the detection member 140 and the housing 20.

Further, similarly to the connector 1 of the embodiment, in the connector 2 of the modified example, the backlash elimination structure 60 capable of keeping the contact between the first contact points 63 at two points and the first target sliding portions 61 at two points and the contact between the second contact point 64 and the second target sliding portion 62 between the temporary locking position and the main locking position is provided. Thus, since the backlash amount in the first orthogonal direction between the temporary locking position and the main locking position relative to the housing 20 becomes zero, the normal posture of the detection member 140 relative to the housing 20 can be kept. Thus, it is possible to improve the detection accuracy of the fitted state between the connector 2 and the counterpart connector C.

Figure 17:
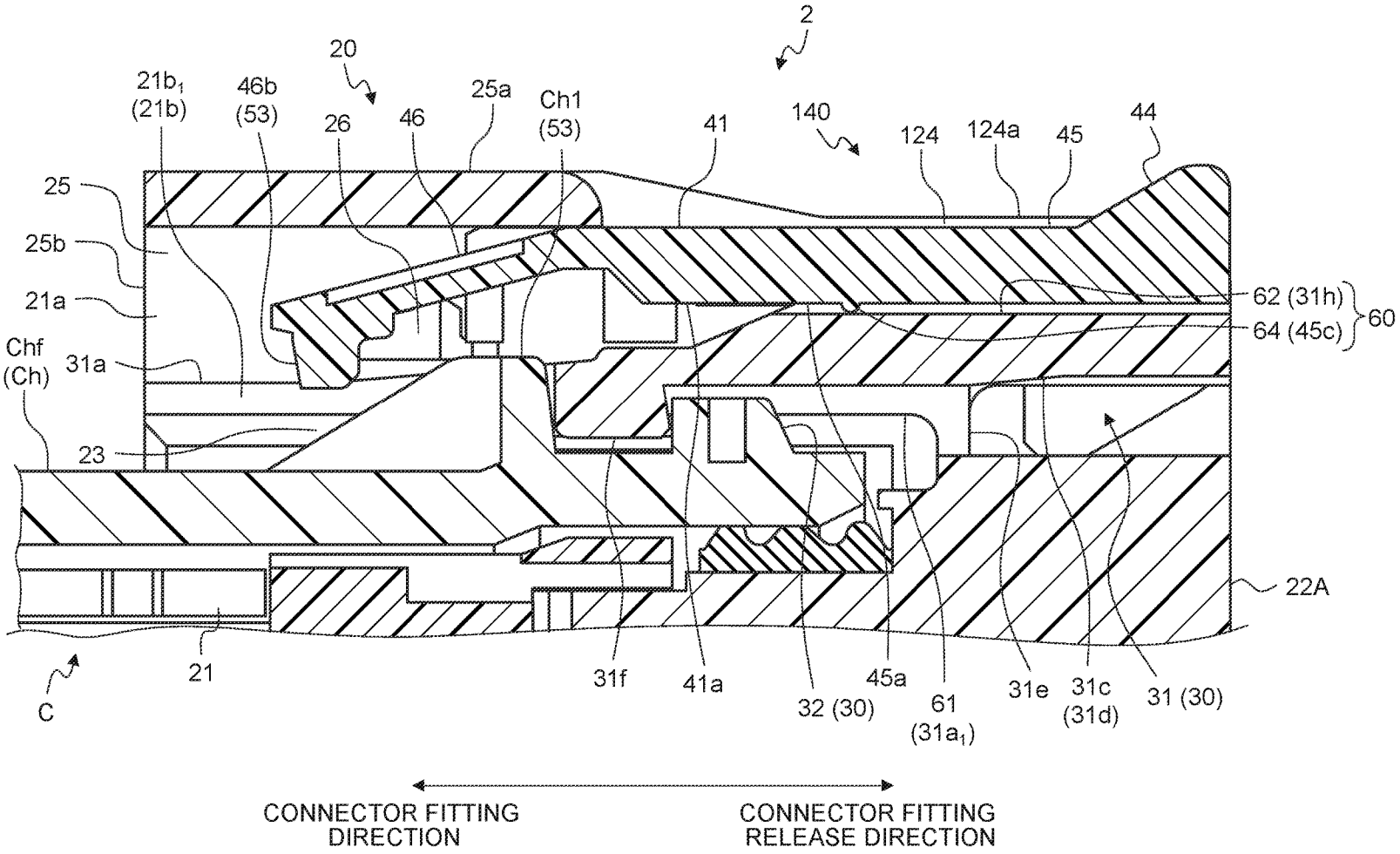
FIG. 17 is a cross-sectional view taken along a line Y-Y of FIG. 15 when the connector and the counterpart connector in the complete fitted state are divided into two parts at the center and is a diagram in which the periphery of the detection member at the main locking position is extracted.
Figure 18:
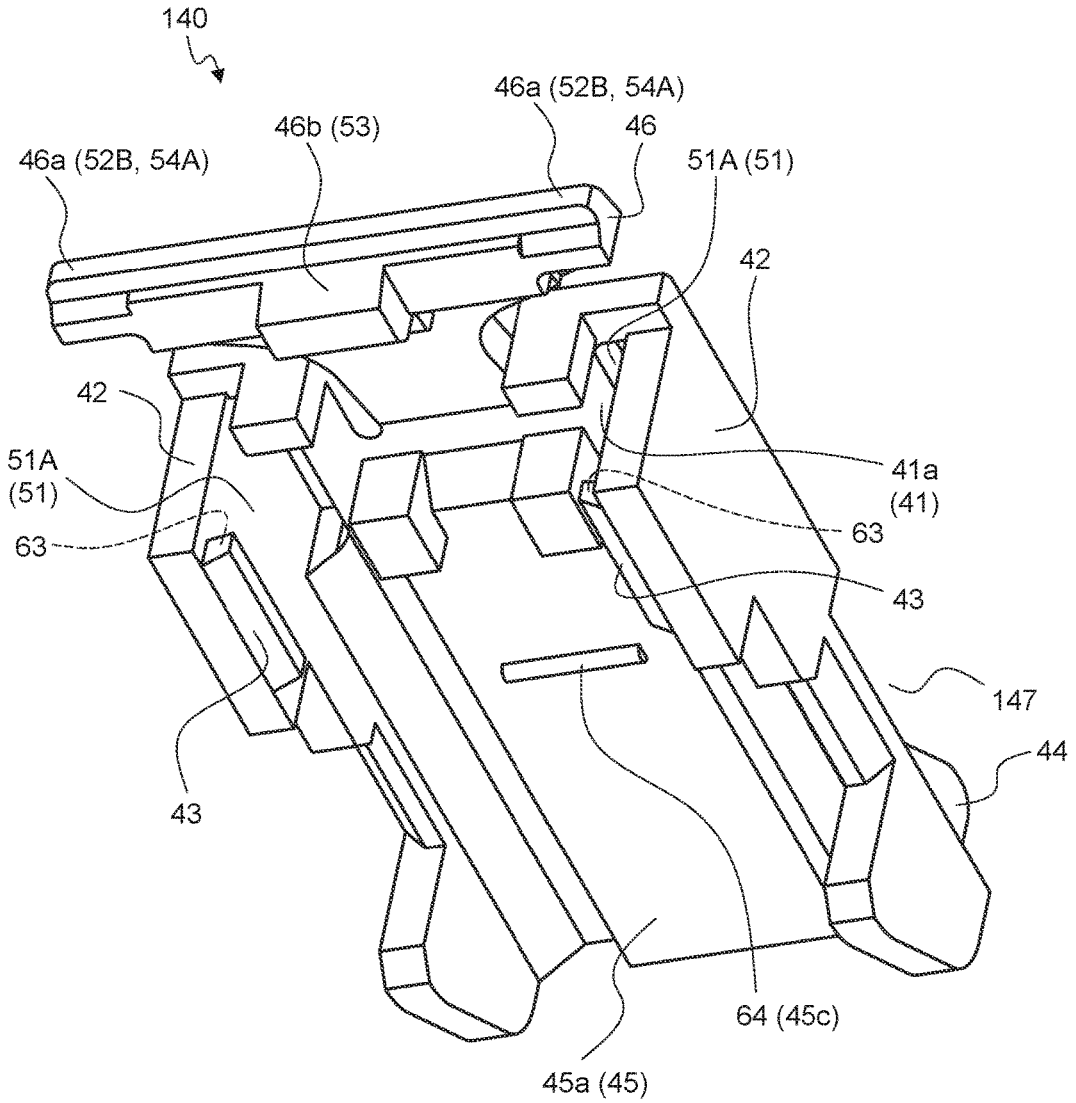
FIG. 18 is a perspective view illustrating a detection member of a modified example.
Figure 19:
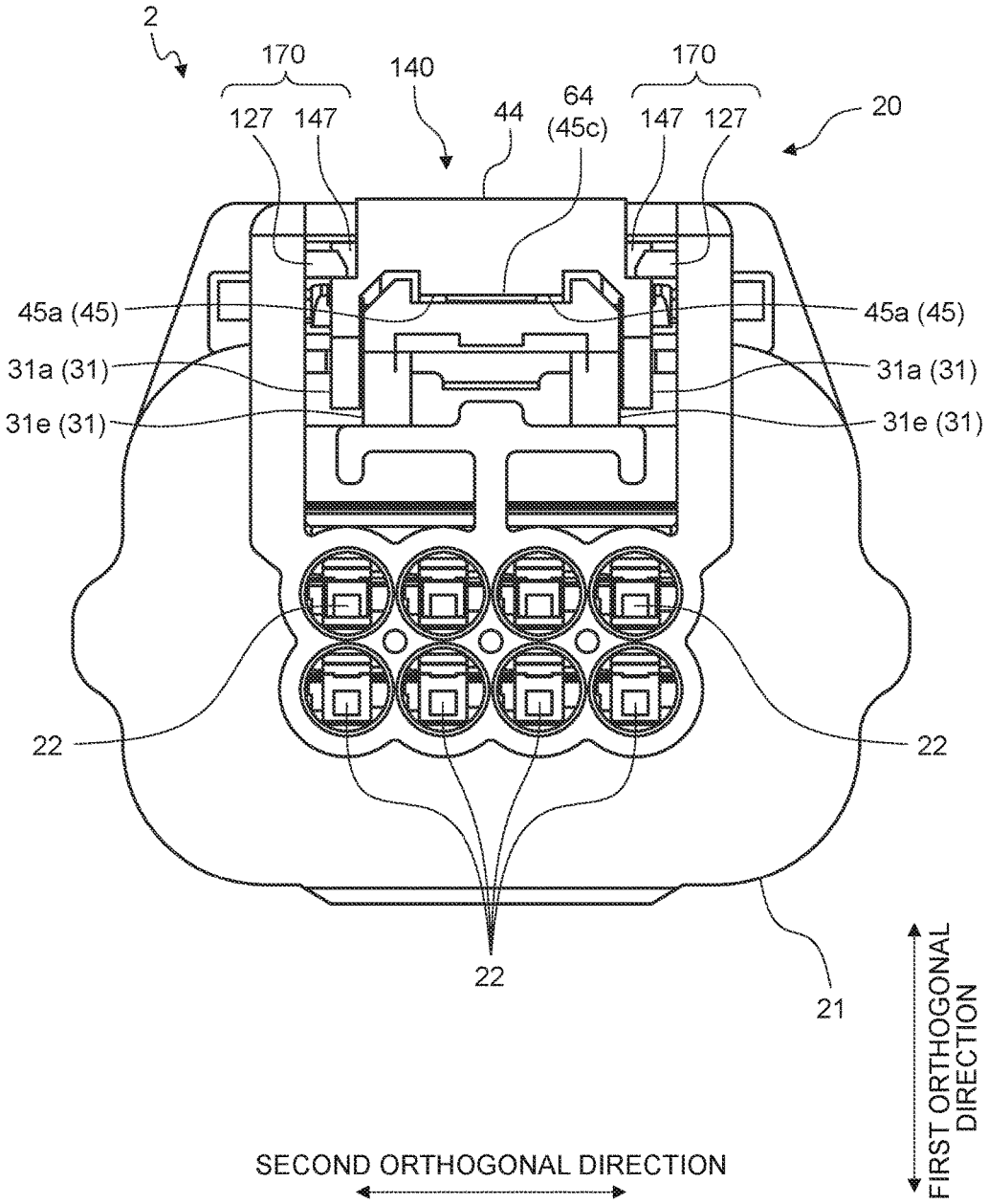
FIG. 19 is a rear view of a connector of a modified example.

Further, in the connector 2 of the modified example, the first target locking body 45 protrudes from the base body 41 so that the end surface of the first target locking body 45 on the side of the connector fitting release direction at the main locking position is flush with the end surface of the housing 20 on the side of the connector fitting release direction (FIG. 17). For this reason, in the connector 2 of the modified example, it is possible to determine the complete fitted state between the connectors by the operator or the like based on the flush state.

Here, in the detection member 140, both ends of the first target locking body 45 in the second orthogonal direction are provided with grooves 147 extending in the connector insertion/extraction direction (FIGS. 12, 14, 15, 18, and 19). Meanwhile, in the housing 20, the protrusion body 127 is provided at each side wall 124*a* (FIGS. 12 and 14) which is a space component forming the operation groove 124. One protrusion body 127 protrudes toward the other protrusion body 127. The protrusion body 127 of this example is formed in a rectangular shape. The grooves 147 and the protrusion bodies 127 are formed and disposed so that the protrusion body 127 is accommodated in the groove 147 when the detection member 140 is assembled to the housing 20 (that is, the temporary locking position) and the protrusion body 127 accommodated in the groove 147 moves in the connector insertion/extraction direction until the detection member 140 moves relatively from the temporary locking position to the main locking position.

The grooves 147 and the protrusion bodies 127 can lock the wall portion of the groove 147 by the protrusion body 127 in a direction (including the first orthogonal direction) intersecting the second orthogonal direction and the connector insertion/extraction direction. Thus, the grooves 147 and the protrusion bodies 127 form a locking structure 170 which locks the movement of the detection member 140 relative to the housing 20 in the intersection direction from the temporary locking position to the main locking position. For this reason, in the connector 2 of the modified example, the first target locking body 45 of the detection member 140 protrudes from the housing 20 at the temporary locking position, but even when an external force is generated so that the electric wire WH drawn out from the housing 20 contacts the detection member 140 at this time, the wall portions of the grooves 147 are locked by the protrusion bodies 127 and thus the separation of the detection member 140 from the housing 20 can be suppressed.

Here, it is desirable to form and dispose the grooves 147 and the protrusion bodies 127 so that both members contact each other before an excessive load is applied from the detection member 140 to the first holding body 31 of the housing 20 when the external force is applied to the detection member 140. Accordingly, in the connector 2, since the durability of the detection member 140 or the housing 20 can be improved, the detection performance of the fitted state between the connectors using the detection member 140 or the operation of the holding structure 30 using the first holding body 31 can be ensured.

Further, in the grooves 147 and the protrusion bodies 127, the wall portion of the groove 147 on the side of the connector fitting direction and the wall portion of the protrusion body 127 on the side of the connector fitting direction face each other in the connector insertion/extraction direction. For this reason, here, a gap between the wall portions at the main locking position is narrowed so that the grooves 147 and the protrusion bodies 127 are used as the second main locking structures in order to lock the movement of the detection member 140 in the connector fitting direction at the main locking position.

The connector according to the embodiment can set the backlash amount between the detection member and the housing to zero without degrading the assembling workability of the detection member with respect to the housing. Thus, the connector can improve the detection accuracy of the fitted state between the connector and the counterpart connector using the detection member while ensuring simple assembling workability of the detection member.

Although the present invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal;

a housing that accommodates and holds the terminal and engages with a counterpart housing when a fitted state with respect to a counterpart connector is in a complete fitted state;

a detection member that is assembled to the housing and is movable relative to the housing between a temporary locking position until the fitted state becomes the complete fitted state and a main locking position when the fitted state is in the complete fitted state;

a temporary locking release structure that presses a temporary locking release portion of the detection member in a release operation direction orthogonal to a relative movement direction of the detection member during the relative movement, and releases a temporary locked state of the detection member at the temporary locking position; and a backlash elimination structure that sets a backlash amount between the housing and the detection member to be zero in the release operation direction and the opposite direction thereof, wherein the backlash elimination structure includes first and second target sliding portions which are formed at the housing to follow the relative movement direction, a first contact point which is provided at the detection member, faces the first target sliding portion in the release operation direction between the temporary locking position and the main locking position, and contacts the first target sliding portion between the temporary locking position and the main locking position, and a second contact point which is provided at the detection member, faces the second target sliding portion in a direction opposite to the release operation direction between the temporary locking position and the main locking position, and contacts the second target sliding portion between the temporary locking position and the main locking position such that the detection member sandwiches the first target sliding portion and the second target sliding portion between the first contact point and the second contact point, the first contact point and the second contact point are disposed to be displaced from each other in the relative movement direction, the detection member includes a base body which is disposed at the first contact point on the side of the release operation direction and is disposed in the release operation direction to be separated from a wall portion located on the side of the release operation direction in relation to the first target sliding portion of the housing, a first connection body which connects the base body and the first contact point to each other, and a second connection body which is disposed to be separated from the wall portion in the release operation direction and connects the base body and the second contact point to each other, the detection member has flexibility so that the base body moves in a direction opposite to the release operation direction to approach the wall portion, and the second contact point is a protrusion.

2. The connector according to claim 1, wherein a plurality of the first connection bodies are provided to be separated from each other in a direction orthogonal to the release operation direction and the relative movement direction of the base body, and the first contact point is provided at each of the first connection bodies.

3. The connector according to claim 1, wherein the second contact point is provided at a contact body continuous to the second connection body or is an end of the second connection body.

4. The connector according to claim 2, wherein the second contact point is provided at a contact body continuous to the second connection body or is an end of the second connection body.

5. The connector according to claim 1, wherein the second contact point is disposed at the base body on a side opposite to the relative movement direction.

6. The connector according to claim 2, wherein the second contact point is disposed at the base body on a side opposite to the relative movement direction.

7. The connector according to claim 3, wherein the second contact point is disposed at the base body on a side opposite to the relative movement direction.

8. The connector according to claim 4, wherein the second contact point is disposed at the base body on a side opposite to the relative movement direction.

9. The connector according to claim 1, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

10. The connector according to claim 2, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

11. The connector according to claim 3, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

12. The connector according to claim 4, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

13. The connector according to claim 5, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

14. The connector according to claim 6, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

15. The connector according to claim 7, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

16. The connector according to claim 8, wherein the housing includes a holding body which engages with the counterpart housing to keep the complete fitted state, the first target sliding portion is provided at a wall portion on the side opposite to the release operation direction of the holding body, and the second target sliding portion is provided at a wall portion on the side of the release operation direction of the holding body.

* * * * *